US012420969B2

(12) United States Patent
Westarp et al.

(10) Patent No.: US 12,420,969 B2
(45) Date of Patent: Sep. 23, 2025

(54) PACKING MACHINE AND METHOD FOR OPERATION

(71) Applicant: HAVER & BOECKER OHG, Oelde (DE)

(72) Inventors: Christian Westarp, Oelde (DE); Renè Mackel, Diestedde (DE)

(73) Assignee: HAVER & BOECKER OHG, Oelde (DE)

( * ) Notice: Subject to any disclaimer, the term of this patent is extended or adjusted under 35 U.S.C. 154(b) by 54 days.

(21) Appl. No.: 17/998,320

(22) PCT Filed: May 11, 2021

(86) PCT No.: PCT/EP2021/062425

§ 371 (c)(1),
(2) Date: Nov. 9, 2022

(87) PCT Pub. No.: WO2021/228818

PCT Pub. Date: Nov. 18, 2021

(65) Prior Publication Data

US 2023/0234737 A1 Jul. 27, 2023

(30) Foreign Application Priority Data

May 13, 2020 (DE) ..... 102020112991.2

(51) Int. Cl.
*B65B 43/16* (2006.01)
*B65B 1/06* (2006.01)
(Continued)

(52) U.S. Cl.
CPC ..... *B65B 43/16* (2013.01); *B65B 1/06* (2013.01); *B65B 43/465* (2013.01); *B65B 55/24* (2013.01); *B65B 65/003* (2013.01)

(58) Field of Classification Search
CPC .. B65B 1/02; B65B 1/28; B65B 37/02; B65B 31/024; B65B 39/06
(Continued)

(56) References Cited

U.S. PATENT DOCUMENTS 2,054,279 A * 9/1936 Briggs ..... B65B 39/08 141/144
2,376,810 A * 5/1945 Richardson ..... B65B 1/22 177/DIG. 7
(Continued)

FOREIGN PATENT DOCUMENTS

DE 102007015251 A1 10/2008
EP 0844175 B1 1/2000
(Continued)

OTHER PUBLICATIONS

International Search Report and Written Opinion received for PCT/EP2021/062425, mailed Sep. 7, 2021.
(Continued)

*Primary Examiner* — Thanh K Truong
*Assistant Examiner* — Linda J. Hodge
(74) *Attorney, Agent, or Firm* — Greer, Burns & Crain, Ltd

(57) ABSTRACT

A packing machine for filling product into bags including a bag supply, a filling module with a filling nozzle and a bag removal, wherein between the bag supply and the bag removal a transfer device is provided, which is suitable and configured to feed an empty bag from the bag supply to the filling nozzle and to feed the filled bag from the filling nozzle to the bag removal. In a method for operation, an empty bag is fed from the bag supply to the filling module by means of the transfer device and a filled bag is fed by means of the transfer device from the filling module to the bag removal. In a method for maintaining such a packing
(Continued)

machine transfer device is moved to release at least the filling module.

20 Claims, 16 Drawing Sheets

(51) Int. Cl.
*B65B 43/46* (2006.01)
*B65B 55/24* (2006.01)
*B65B 65/00* (2006.01)

(58) Field of Classification Search
USPC ..... 53/473
See application file for complete search history.

(56) References Cited

U.S. PATENT DOCUMENTS 2,753,097 A 7/1956 Kindseth et al.
2,853,842 A * 9/1958 Vredenburg ..... B65B 51/18 53/284.7
3,138,217 A * 6/1964 Bahr ..... B65B 1/18 177/78
3,156,273 A * 11/1964 Piazze ..... B65B 43/36 141/10
3,945,173 A * 3/1976 Buzzi ..... B65B 43/465 53/284.7
3,952,480 A * 4/1976 Nordstrom ..... B65B 7/06 53/562
4,074,507 A * 2/1978 Ruf ..... B65B 55/24 53/502
4,078,358 A * 3/1978 Henderson ..... B65B 61/28 53/573
4,353,198 A * 10/1982 Koppe ..... B65B 43/465 53/570
4,509,313 A * 4/1985 Koppe ..... B65B 39/00 53/570
5,115,619 A * 5/1992 Lieder ..... B65B 7/06 53/570
5,979,512 A * 11/1999 McGregor ..... B65B 43/30 141/10
6,112,504 A * 9/2000 McGregor ..... B65B 39/00 141/10
6,145,709 A * 11/2000 Hogan ..... B65B 39/06 222/254
6,196,278 B1 * 3/2001 Wegman ..... G01F 13/006 141/286
6,269,849 B1 * 8/2001 Fields, Jr. ..... B65B 1/06 141/391
6,431,407 B1 * 8/2002 Hogan ..... B65B 1/366 222/254
6,776,198 B1 * 8/2004 Haines ..... B65B 57/145 141/69
8,312,984 B2 * 11/2012 Scott ..... B65B 3/04 198/465.4
8,763,348 B2 7/2014 Combrink
9,346,568 B2 * 5/2016 Korte ..... B65B 43/465
9,352,860 B2 5/2016 Vollenkemper et al.
10,589,881 B2 * 3/2020 Vollenkemper ..... B65B 43/50
10,625,890 B2 * 4/2020 Vollenkemper ..... B65B 59/005
2009/0205293 A1 * 8/2009 Combrink ..... B29C 66/7373 53/573
2011/0047942 A1 * 3/2011 Combrink ..... B65B 39/14 53/284.7
2011/0107730 A1 * 5/2011 Scott ..... B65B 3/04 53/570
2014/0083559 A1 * 3/2014 Korte ..... B65B 3/04 141/10
2014/0083560 A1 * 3/2014 Vollenkemper ..... B65B 43/465 141/10
2017/0275032 A1 * 9/2017 Vollenkemper ..... B65B 43/14
2017/0291727 A1 * 10/2017 Vollenkemper ..... B65B 63/02
2019/0300216 A1 10/2019 Nakamoto
2020/0062429 A1 2/2020 Felling et al.
2023/0234737 A1 * 7/2023 Westarp ..... B65B 39/06 53/473

FOREIGN PATENT DOCUMENTS

EP 1479607 A1 * 11/2004 ..... B65B 43/465
EP 1733971 A1 * 12/2006 ..... B65B 43/465
EP 2130790 A1 12/2009
EP 3321195 A1 5/2018
WO 2010002334 A1 1/2010

OTHER PUBLICATIONS

German Search Report received for 102020112991.2, dated Feb. 19, 2021.

* cited by examiner

PACKING MACHINE AND METHOD FOR OPERATION

BACKGROUND

The present invention relates to a packing machine for filling bulk materials into bags comprising at least one bag supply, at least one filling module with at least one filling nozzle and at least one bag removal. The present invention additionally relates to a method for operating such a packing machine and furthermore a method for maintaining such a packing machine.

Various installations and methods are known in the prior art for filling bulk materials into containers, in particular for filling pourable and/or free-flowing products into bags.

In this case, there are, inter alia, various and in some cases, special solutions for filling open bags and valve bags. The performance also plays a major role in the type of installation and in the filling method.

In this case, for example, rotating packing installations or packing machines have become known which comprise a plurality of filling modules arranged distributed over the circumference on a type of carousel each having a filling nozzle. For filling the bags a bag is placed or shot onto a filling nozzle at a specific location. During rotation of the packing machine the bag is filled, compacted depending on the design, closed and transferred to another position.

Also substantially linearly arranged packing installations or packing machines have become known in which a bag to be filled is taken from a stack of bags, for example, transferred to a filling module and filled and then removed.

Such installations usually function reliably and can be selected from a plurality of possible configurations as required and demanded.

However, there is still the need for alternative solutions since the known packing machines do not always meet the existing available space and frequently cannot be flexibly adapted to the product to be filled. Also maintenance is expensive in some cases since the known packing installations usually have a very compact and partially installed structure in order to keep the space requirement as low as possible.

It is therefore the object of the present invention to provide a packing machine which can be used flexibly or adapted in a modular manner for example and which, in particular despite a preferably compact design, is easier to maintain.

SUMMARY

The packing machine according to the invention is suitable for filling product and in particular bulk materials into bags and comprises at least one bag supply, at least one filling module with at least one filling nozzle and at least one bag removal. In this case, at least one transfer device is provided between the bag supply and the bag removal which is suitable and configured to supply an empty bag from the bag supply to the filling nozzle and remove the filled bag from the filling nozzle and supply it to the bag removal.

In this case, here in particular, a T-shaped arrangement of the individual assemblies or modules with respect to one another is provided. Thus, in particular the bag supply and the bag removal are arranged in a line. The transfer device is also provided in between in this line, which feeds the bags out from the line to the filling module, wherein the filling module is preferably arranged in a T-shaped arrangement pulled out of the line and preferably transversely next to the transfer device.

As a result of such an arrangement it is preferably possible to assign each arbitrary module to the remaining components or assemblies of the packing machine without necessitating major modification work or complex configurations. In addition, a flexible and nevertheless particularly small packing machine is provided as a result of the T-shaped arrangement.

The bag supply is in particular a module or an assembly which preferably provides pre-fabricated bags e.g. in a magazine or on a stack of bags so that they can be picked up individually by the transfer device. Depending on the configuration, however, the bag supply can also comprise a bag production or be provided by a bag production.

Particularly preferably the packing machine is suitable and configured to fill open bags with bulk material.

It is self-evident that even if the application is described with reference to the filling of bulk materials, the filling of pasty and/or liquid products in bags similar thereto with the packing machine according to the invention is also possible or also covered by the protection.

The bag removal preferably comprises at least one conveyor belt by means of which a filled and closed bag can be removed. In particular, at least one closure station is provided for closing the filled bags, which is preferably assigned to the bag removal.

The packing machine according to the invention offers many advantages. A considerable advantage is that due to the provision of a transfer device, the T-shaped arrangement of the filling module with respect to the remaining components or assemblies of the packing machine is possible. The transfer device moves an empty bag out from the line in which the other assemblies are arranged in the direction of the filling module and attaches the empty bag to the filling nozzle. In addition, the transfer device is also suitable and configured to remove the full bag from the filling nozzle and supply it to bag transport. For this purpose the full bag is guided back into the line of the other assemblies and transferred to bag removal.

As a result of the T-shaped arrangement or since the filling module can be placed next to the remaining assemblies of the packing machine, a particularly small and compact packing machine is provided by means of the transfer device, wherein this can be flexibly selected as required as a result of the adjacent arrangement of the filling module. In particular, standard assemblies can be used so that a filling module provided can also be integrated in the packing machine according to the invention, preferably selected from a row of variants e.g. various filling principles such as air, turbine, screw, free fall and/or the like without needing to change the other modules.

In known in-line installations, i.e. installations in which all the modules are arranged in a line, it can be difficult for reasons of space to arrange the filling technology, in particular in configurations with an air filling module, in a line. In addition, the operability or maintainability would be made difficult. This is substantially improved by the packing machine or arrangement according to the invention.

Preferably the transfer device comprises at least a first gripper device in order to supply empty bags from the bag supply to the filling nozzle and at least one second gripper device in order to remove full bags from the filling nozzle and supply them to bag removal. As a result of such an arrangement, the handling of empty and full bags can be reliably achieved by means of the gripper devices.

Preferably the filling module can be decoupled and removed from the other assemblies or modules without major expenditure so that maintenance expenditure is reduced.

Particularly preferably the first gripper device is provided for transport of the empty bags and the second gripper device is provided for transfer of the full bags to different sides of the transfer device. As a result of such a configuration, it is possible that different handling steps of the transfer device are executed in parallel. In particular, it is possible to work simultaneously on different sides of the transfer device with the result that it is possible on the one hand to take an empty bag from the bag supply and at the same time remove a full bag from the filling nozzle and/or hang an empty bag onto the filling nozzle and supply a full bag to bag removal.

In expedient further developments to this end, the first gripper device for transport transfer of the empty bags and the second gripper device for transfer of the full bags are arranged offset with respect to one another between 60° and 120°, preferably between 80° and 100° and in particular 90° with respect to one another on a transfer device. The parallel handling of full and empty bags is made possible as a result. Depending on the configuration, different angles with respect to one another can advantageously be selected if, for example, the bag supply and the bag removal are arranged in an angled arrangement with respect to one another which does not form a straight line.

In preferred embodiments the transfer device is provided to be rotatable and/or pivotable at least in sections. In this case, the transfer device comprises at least one rotatable element or a type of pillar on which, in particular the gripper devices are arranged. It is thus possible that by rotation of the transfer device or the pillar it is possible to transfer empty bags from the bag supply to the filling nozzle and full bags from the filling nozzle to the bag removal. This is achieved in particular by the to and fro displacement or rotation of the transfer device or the pillar.

Particularly preferably the transfer device or at least a part thereof is rotatable between 60° and 120°, preferably between 80° and 100° and in particular by 90°. It is thus possible that by rotating to and fro, e.g. by 90° in each case, a bag can be conveyed out from the line and in again by 180° by the gripper devices arranged on different sides. This is achieved whereby the first gripper device is initially rotated by 90° in one direction and attaches the empty bag to the filling nozzle. The transfer device then rotates back so that the second gripper device comes in contact with the then filled bag on the filling nozzle. As a result of rotating back again by 90°, the bag is supplied to bag removal. Smaller or larger angles can also advantageously be provided here if, for example, the bag supply and the bag removal are in an angled arrangement with respect to one another which does not form a straight line.

Particularly preferably the transfer device is configured to be displaceable at least in sections. In this case, displaceable is to be understood in particular also as movable, wherein preferably a longitudinal and/or transverse displacement is possible. Thus, it is in particular possible that the transfer device travels on rails or is suspended on rails and/or is configured to be movable in a different manner in order to pull this out transversely to the arrangement or line of bag supply and bag removal or however to move this in the direction of or along the line of the arrangement of bag supply and bag removal. In this case, the transfer device can be pulled out with respect to the linear arrangement in order to provide sufficient access to the filling module, in particular for maintenance work. By pulling out the transfer device, sufficient space is provided for a person to step between transfer device, bag supply, bag removal and filling module or filling modules so that all the assemblies are readily accessible. In particular, if two filling modules are arranged next to one another which are served by the transfer device as required, the transfer device can be provided to be shiftable or displaceable or movable along the line or in the direction from the bag supply to the bag removal or conversely in order to always arrange this ahead of the filling module which is not to be maintained straight away or which is to be used straight away.

Preferably the first gripper device is provided to be displaceable for the transfer of the empty bags. In this case, the gripper device can preferably be moved forwards and backwards at least in sections in order to take an empty bag from the bag supply and bring this in contact with the filling nozzle after rotation of the transfer device. In this case, the first gripper device can be configured, for example, to be pivotable forwards and back again or displaceable or also telescopable.

In expedient further developments, the first gripper device comprises two gripper arms which in particular can be displaced relative to one another. In this case, these gripper arms can in particular be brought together and moved apart in order to receive an open empty bag from the bag supply and transport or transfer it open in the direction of the filling module in order to hang the open bag on the filling nozzle.

In advantageous further developments the second gripper device for the transfer of full bags is provided to be displaceable, at least in sections. In this case, the second gripper device can in particular be displaced forwards and backwards. To this end, for example, a parallelogram-shaped configuration of the second gripper device can be provided, for example.

Preferably the second gripper device comprises at least one clamping device. In this case, such a clamping device can be provided in particular to remove the full bag from the filling nozzle and in this case in particular to press the still-open bag walls against one another so that the bag walls rest on one another for the subsequent closure.

Preferably the second gripper device is assigned at least one cleaning device. In this case, the cleaning device is used here for cleaning the area of the filled bag on which the top seam is provided subsequently.

The cleaning device preferably comprises at least one blowing strip having at least one first nozzle device and at least one second nozzle device through which at least one air stream can be guided in each case at least temporarily. Preferably the first nozzle device has a fixed blowing-out direction, wherein the second nozzle device also has a fixed blowing-out direction. In this case, the blowing-out directions of the first nozzle device and the second nozzle device differ from one another. Furthermore, preferably at least one control device is provided which is suitable and configured to control the at least one first nozzle device and the at least one second nozzle device at least temporarily in a temporally staggered manner.

A nozzle device can in this case preferably be provided by any known and expediently usable type of nozzle or comprise such a nozzle. A nozzle device can, for example, also be provided by a simple opening or hole or comprise an opening or hole through which an air stream or fluid stream can escape. In this case, such an opening can in particular be considered to be slit-like so that with such an elongate nozzle device longer sections can also be cleaned in one piece with air.

As a result of the different blowing-out directions of the first and the second nozzle device and depending on the configuration of each further nozzle device and the temporally staggered or different control of the nozzle devices via a component with static nozzle devices or nozzles, in particular the air movement of a moving nozzle or an oscillating air jet can be simulated. Thus, an effective cleaning of a working section can be ensured without the need to use moving parts which are more expensive to manufacture and maintain.

As a result of such a configuration of the cleaning device, it can be achieved that during cleaning of the bag mouth edge before closure or welding of the filled bag by the moving air stream, the bag walls or film layers lying on top of one another are opened by the acting air jet so that the air jet impinges upon the inner surfaces with the result that the adhering dust or dirt particles are removed. By varying the air jet preferably with a suitable configuration of the bag, the layers of the side gussets are separated from one another so that this area is also cleaned. The individual film layers are opened quasi successively by the moving or oscillating air stream and cleaned by the thus penetrating air stream.

Additionally, in addition to simulating a simple oscillating movement of an air stream, more complex air streams can be produced in simple and/or complex wave movements over the section to be cleaned.

The different types of nozzle devices can be controlled separately and/or jointly in groups in order to produce suitable air movements.

In particular, the individual nozzle devices can be arranged in rows along the blowing strip wherein the individual rows or groups of nozzle devices of different rows can be acted upon separately with air in order to achieve an advantageous air stream or an advantageous air movement.

Particularly preferably the bag supply, the filling module, the bag removal and/or the transfer device are arranged in at least one housing device at least in sections. In this case, preferably a common cover or housing device is provided. However, depending on the configuration the modules can preferably also be arranged individually or also in groups in separate housing devices. In this case, such housing devices are in particular configured to be substantially dust- and/or airtight so that preferably a hermetic sealing of the entire packing machine is made possible.

Preferably at least two filling modules are provided. In this case, it is provided in particular that only one filling module is used in each case. In particular, different properties can be provided at the filling module so that, for example, a fast product change is possible on a packing machine. To this end, it is provided that the transfer device is movable or displaceable at least in the longitudinal direction of the packing machine or in the line of bag supply and bag removal so that the transfer device can be moved in front of the corresponding filling module to be used. To this end, the filling modules are in particular arranged next to one another.

If at least two filling modules are provided next to one another, the transfer device can preferably be configured and adapted to accept empty bags from the bag supply and to feed full bags to the bag removal, regardless of the filling module in front of which the transfer device is currently located. For this purpose, in particular, the distance between transfer device and bag supply and bag removal can be bridged regardless of the position of the transfer device, for example, by a correspondingly displaceable gripper device. Preferably both filling modules can also be operated alternately, for example, by attaching an empty bag to the first filling module and removing a filled bag from the second filling module.

The method according to the invention is suitable for operating a packing machine as described previously. In this case, the method is characterized by the following steps in a suitable number, suitable order and/or combination:

a) picking up an empty bag by the first gripper device (5)
b) turning the transfer device (4) until the first gripper device (5) is in operative connection with the filling module (100)
c) transferring the empty bag to the filling nozzle (101)
d) turning the transfer device (4) until the first gripper device (5) is in operative connection with the bag supply (2)
e) turning or turning back the transfer device (4) until the second gripper device (6) is in operative connection with the filling module (100) or with the filled bag
f) Picking up the full bag by the second gripper device (6)
g) Turning the transfer device (4) until the second gripper device with the full bag is in operative connection with the bag removal
h) Handing over the bag to the bag removal.

The method according to the invention also offers the advantages such as have already been described previously for the packing machine. In particular, as a result of the method according to the invention it is possible to provide a packing machine arranged in a T shape, wherein in particular any filling module can be arranged next to the remaining assemblies or modules of the packing machine arranged in a line.

Steps a) and f), b) and g), c) and h) and/or d) and e) are preferably carried out in parallel or simultaneously. It is in particular preferred in this case that at least temporarily a new empty bag is picked up by the first gripper device and transferred to the filling nozzle when a full bag is removed from the filling nozzle by the second gripper device and transferred in the direction of the bag removal. In this way, the packing machine can be operated in parallel and thus consequently with a higher performance.

Particularly preferably, at least two filling modules are provided, wherein the transfer device is moved in front of the filling module, which is to be used directly. As already described previously, it is possible, for example, to make a quick product change on a machine since different filling modules can be installed in parallel on the machine. Alternatively, it is preferable to work with the same filling modules and the same product in order to increase the overall performance of the packing machine, in particular when a product is filled, which requires a longer residence time in each case for compaction or venting at the filling nozzle.

A further method according to the invention is suitable for maintaining a packing machine such as has been described previously. In this case, the transfer device is moved to release at least the filling module. As a result of the transfer device method a user or maintenance staff are provided with sufficient space in the packing machine between the various assemblies, which enables a particularly simple and therefore also reliable and time-saving maintenance of all components. In addition to the easier access to the filling module, all the other assemblies, in particular the bag supply and the bag removal and the side of the transfer device facing the filling module can be reached more easily.

Particularly preferably, the transfer device is pulled out transversely to the arrangement or line of bag supply and bag removal. This is particularly advantageous if only one filling module is used and a very compact arrangement of the individual assemblies is provided.

In a particularly preferred embodiment, two filling modules are provided, wherein the transfer device is moved in the line between bag supply and bag removal or longitudinal direction. In this case, the transfer device is in particular moved in front of the filling module which is currently not to be maintained and/or which is just to be used for filling.

Further advantages and features of the present invention are obtained from the exemplary embodiment, which is explained hereinafter with reference to the appended figures.

DETAILED DESCRIPTION

Figure 1:
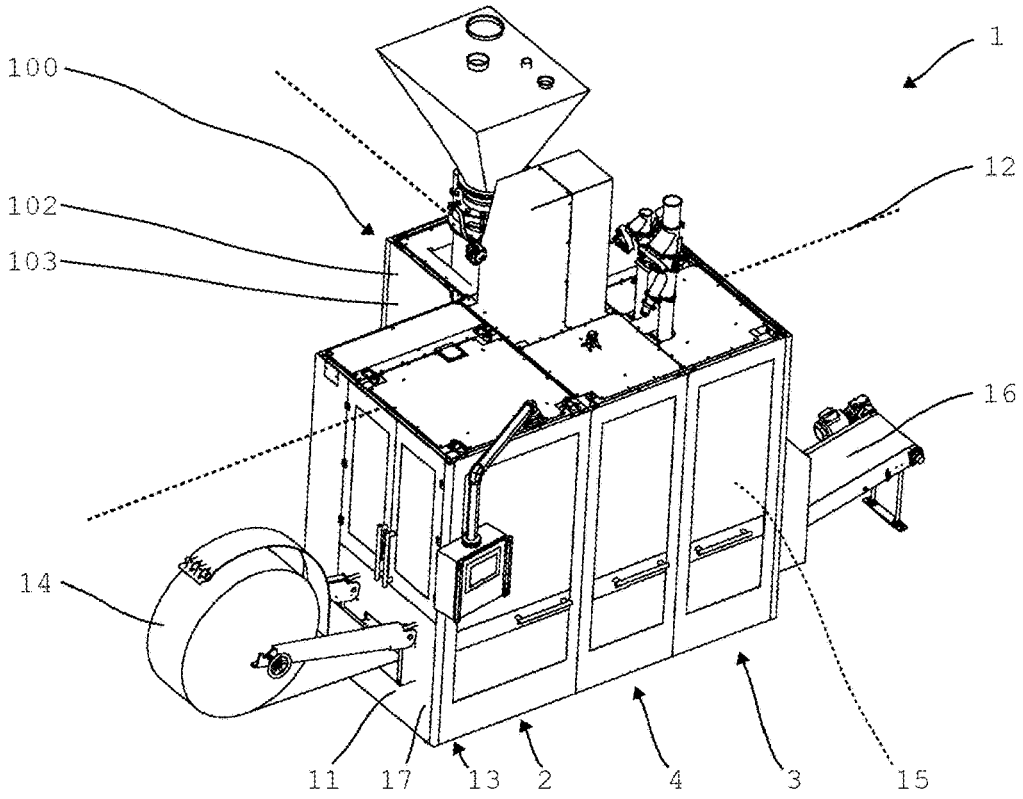
FIG. 1 shows a purely schematic diagram of an exemplary embodiment of a packing machine according to the invention in a perspective view.

FIG. 1 shows a packing machine 1 according to the invention in a perspective view. In this case, the packing machine 1 in the exemplary embodiment shown here comprises a bag supply 2, a bag removal 3 and an interposed transfer device 4. The bag supply 2, the bag removal 3 and the transfer device 4 are in this case arranged in a line 12.

A filling module 100 is provided, pulled out of line 12 and arranged in the exemplary embodiment shown here next to the transfer device 4. In the exemplary embodiment shown here, empty bags from the bag supply 2 are fed to the filling module 100 by means of the transfer device 4. The bag thus supplied to the filling module 100 is attached to the filling nozzle 101 of the filling module 100 and filled and guided by the transfer device 4 back into the line 12 and fed to the bag removal 3.

By arranging the filling module 100 next to the line or pulling out from the line, almost any filling module 100 can be used together with the modules or assemblies of the packing machine 1 arranged in the line 12. In particular, standard modules can also be used so that no special configuration of a filling module 100 must be provided for the packing machine according to the invention, preferably modules for filling open bags of any filling technology.

In the exemplary embodiment shown here, the packing machine 1 is provided encapsulated, for which the individual assemblies or modules are provided in housing devices 11, 102. In this case, in the exemplary embodiment shown here, the assemblies arranged in line 12, namely the bag supply 2, the bag removal 3 and the transfer device 4 are provided in a common housing device 11. In the exemplary embodiment shown here, the filling module 10 is provided in its own housing device 102.

By arranging the individual assemblies or modules in housing devices 11, 102, it is possible to hermetically seal off the filling process depending on the configuration so that hazardous or sensitive substances can also be filled by means of the packing machine 1. In particular, in the packing machine 1 or in the housing devices 11, 102 a vacuum can also be applied or a suction can take place so that product which escapes during filling does not escape into the environment but can be safely disposed of or even recycled.

In the exemplary embodiment shown here the bag supply 2 also comprises a bag production 13, wherein bags are produced for this purpose starting from a film supply 14 and made available to the transfer device 4.

In the exemplary embodiment shown here the bag removal 3 comprises a closing device 15, by means of which the filled and still open bags can be closed and a conveyor belt 16 for the removal of the filled and closed bags.

Since the bag supply 2, the bag removal 3 and the transfer device are arranged in a line 12 and the filling module 100 is arranged pulled out of this line 12, this results in a T-shaped arrangement of the packing machine 1 according to the invention.

As already mentioned previously, this offers many advantages. An advantage is that by juxtaposing the filling module 100 or by pulling out the filling module 100 from the line 12, almost any (standard) filling module can be used. As a result, on the one hand, existing filling modules 100 can be used. On the other hand, due to the juxtaposition a filling module can also be changed or exchanged quickly without too much effort. In known inline systems, i.e., systems in which everything is arranged in a line, for reasons of space it can be difficult to arrange the filling technology, in particular the air filling module 105 with pressure chamber 106 shown in the exemplary embodiment, in line. In addition, operability or maintainability would be more difficult.

Another advantage is that due to the T-shaped configuration or arrangement of the packing machine a particularly compact design is possible.

Figure 2:
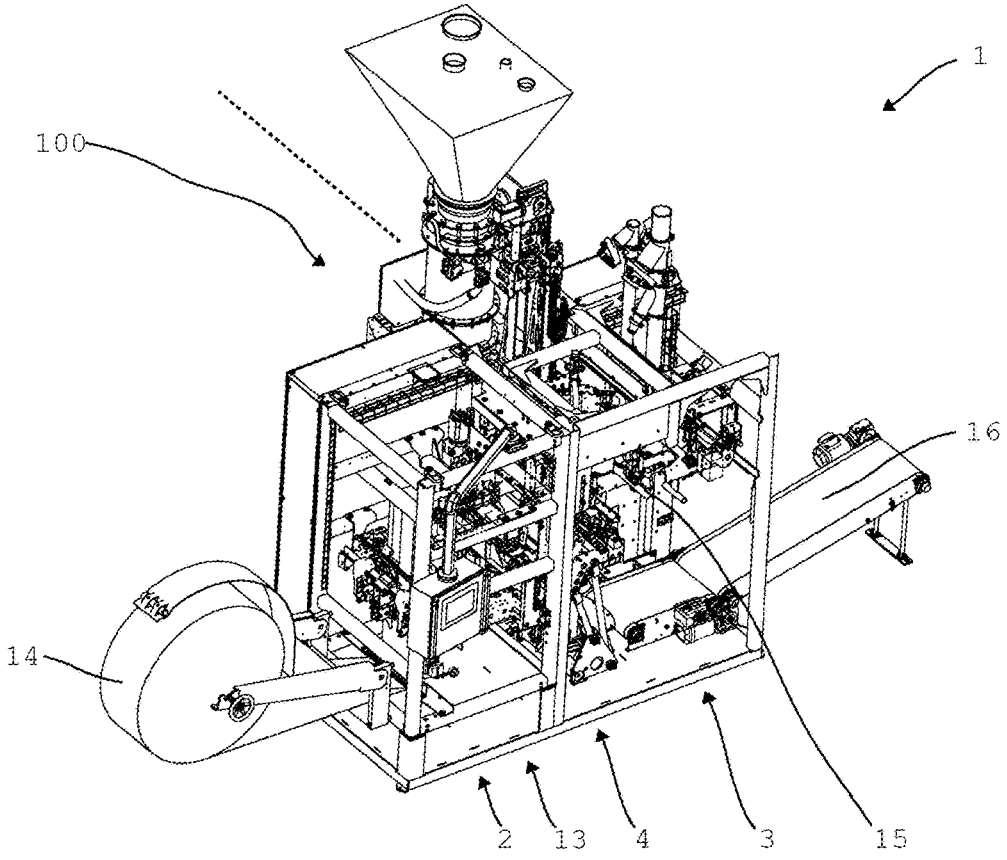
FIG. 2 shows a further purely schematic diagram of an exemplary embodiment of a packing machine according to the invention in a perspective view.
Figure 3:
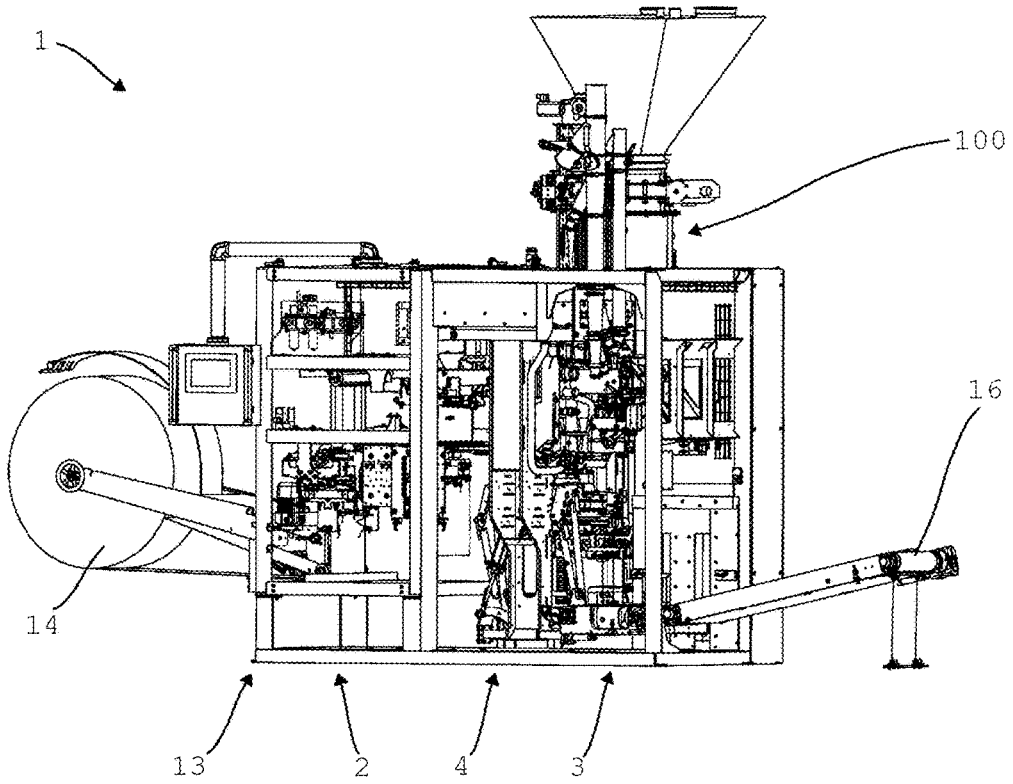
FIG. 3 shows a next purely schematic diagram of an exemplary embodiment of a packing machine according to the invention in a perspective view.
Figure 4:
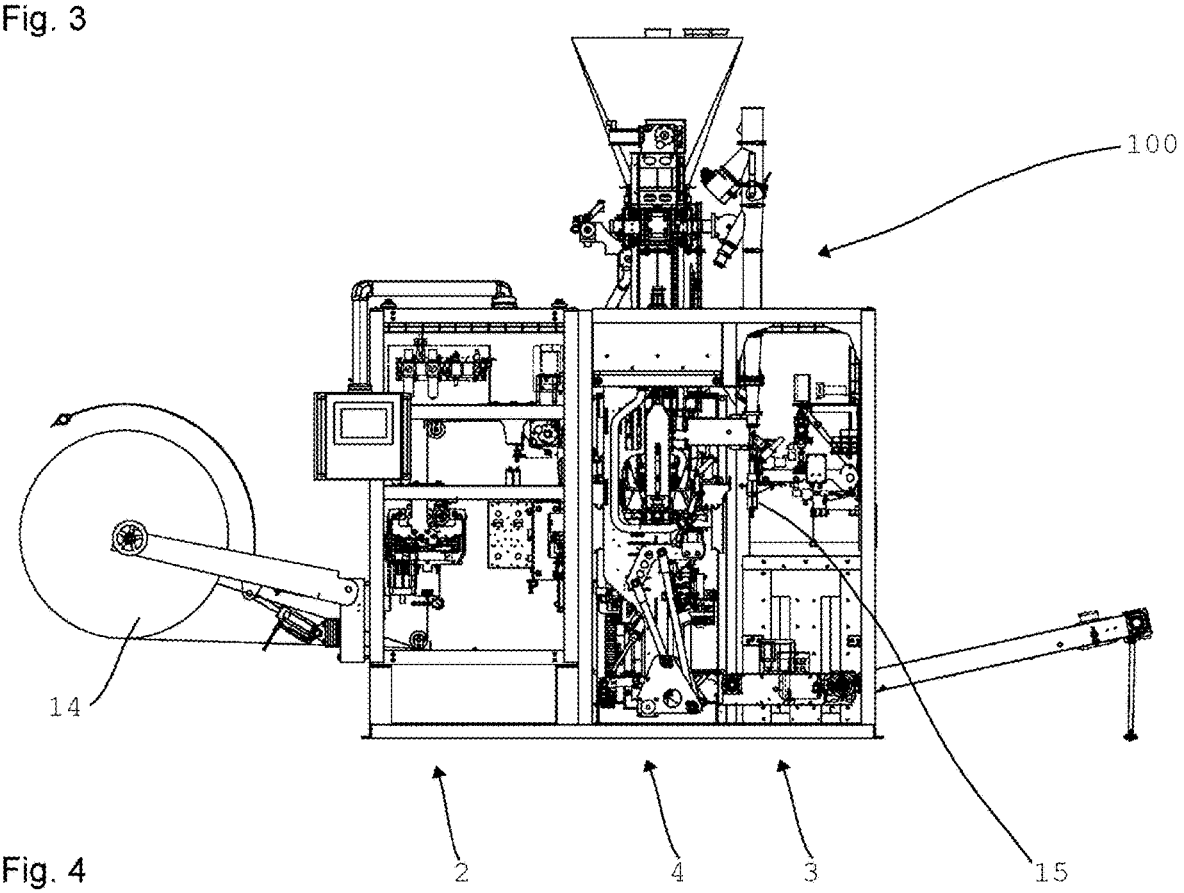
FIG. 4 shows a purely schematic diagram of an exemplary embodiment of a packing machine according to the invention in a view from the front.

For better illustration of the packing machine 1, FIGS. 2 to 4 show two perspective views and a front view of the packing machine 1, wherein in the housing devices 11, 102, the housing covers 17, 103 are not shown to provide overview views of the interior of the packing machine 1 or of the various modules or assemblies.

Figure 5:
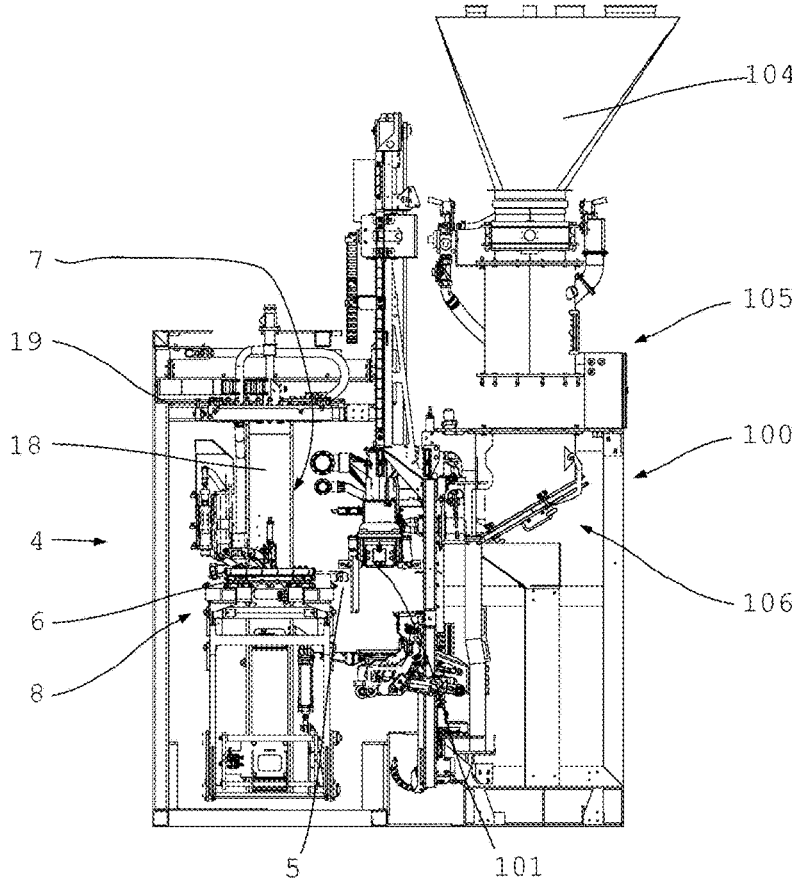
FIG. 5 shows a purely schematic diagram of an exemplary embodiment of a packing machine according to the invention in a view from the side of the bag removal.
Figure 6:
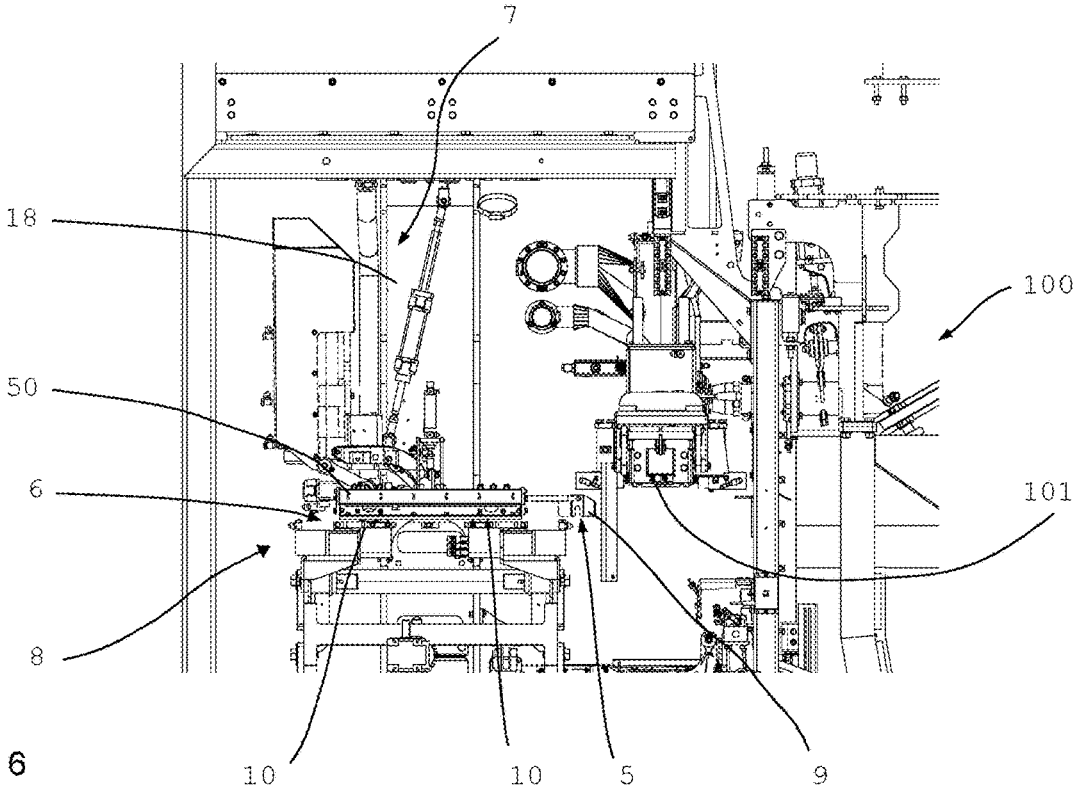
FIG. 6 shows a further purely schematic diagram of an exemplary embodiment of a packing machine according to the invention in a view from the side of the bag removal.

In FIGS. 5 and 6, the view of the transfer device 4 from the side of the bag removal 3 is shown once in an overview view and once in an enlarged diagram.

In this view, it can be seen that the filling module 100 is provided or arranged next to the transfer device 4, wherein the filling nozzle 101 of the filling module 100 can also be identified in this view. Here the inlet hopper 104 of the filling module 100 can also be seen, which is connected to a silo for product to be filled, which is located thereabove but not shown. In this case, product is fed via the inlet hopper 104 into the pressure chamber 106 inside the filling module 100 or here the air filling module 105 to the filling nozzle 101.

In this view it can be seen that the transfer device comprises a first gripper device 5 and a second gripper device 6, which are mounted on different sides 7, 8 of the transfer device 4 or on a base body 18 of the transfer device 4.

It is shown here that the base body 18 of the transfer device 4 is configured in a pillar-like manner here and is provided in a suspended manner in the exemplary embodiment shown here. In the exemplary embodiment shown, the base body 18 is suspended on rails 19, whereby the base body 19 with the gripper devices 5, 6 can be pulled out in this view to the left from the line 12. This displaceability of transfer device 4 will be shown and described in more detail later.

In addition to the displaceability of the transfer device 4 or the base body 18 of the transfer device 4, the base body 18 can also be rotated by 90° back and forth in the exemplary embodiment shown here. By turning back and forth the base body 18 of the transfer device 4 and by arranging the first gripper device 5 on one side 7 of the base body 18 and arranging the second gripper device 6 on the side 8 of the base body 18, by turning the base body 18 back and forth through 90° a bag from the bag supply 2 can be fed by means of the transfer device 4 out from line 12 to the filling module 100 or the filling nozzle 101. When the base body 18 or the transfer device 4 turns back, the second gripper device 6 comes in contact with the now filled bag at the filling nozzle 101 and can pick this up and can be guided back into the line 12 by turning forwards or re-turning the base body 18 and fed to the bag removal.

In the enlargement in FIG. 6 the first gripper device 5 and the second gripper device 6 can be identified on different sides 7, 8 of the base body 18 of the transfer device 4. One of the two gripper arms 9 of the first gripper device 5 can also be identified here.

Figure 7:
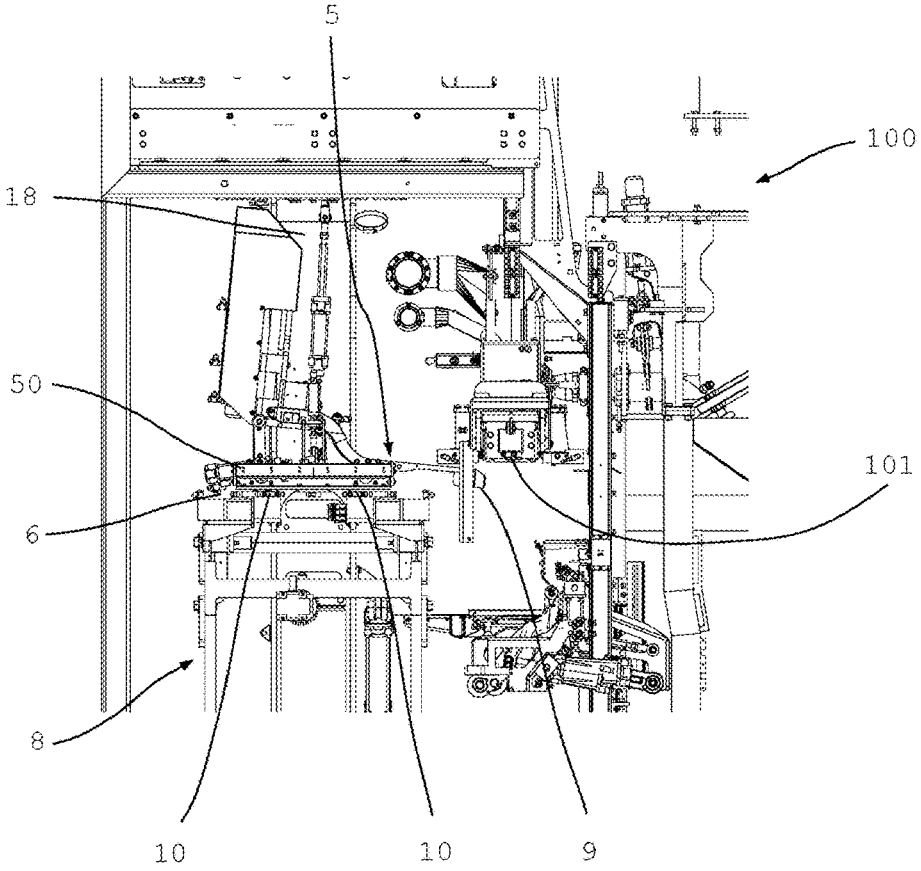
FIG. 7 shows a next purely schematic diagram of an exemplary embodiment of a packing machine according to the invention in a view from the side of the bag removal.
Figure 8:
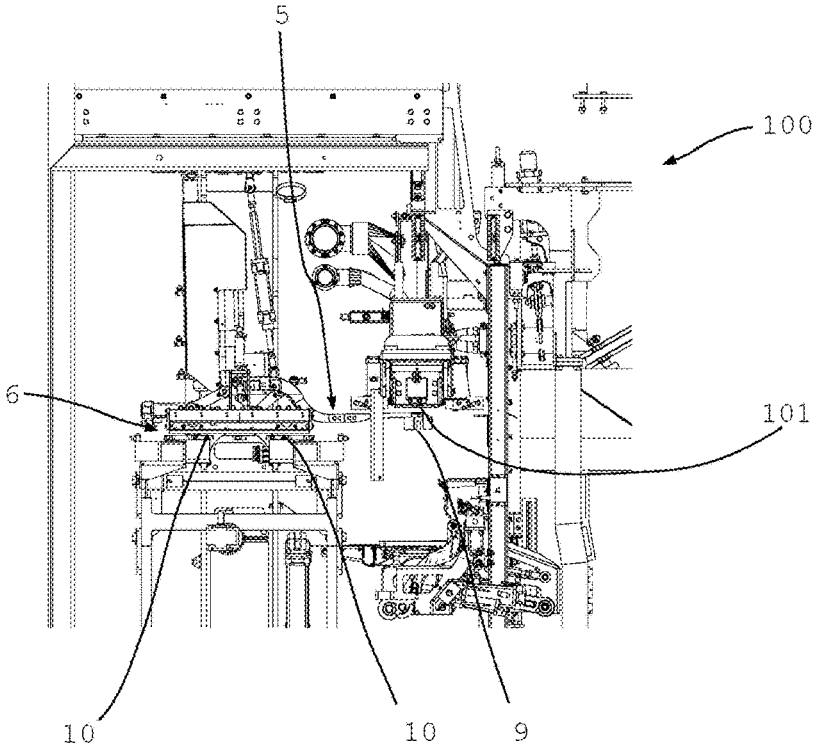
FIG. 8 shows another purely schematic diagram of an exemplary embodiment of a packing machine according to the invention in a view from the side of the bag removal.

As can be seen in more detail in the following figures, in the exemplary embodiment shown here the gripper device 5 comprises two gripper arms 9 which can be moved relative to each other so that they serve as a kind of spreader. Thus, it is possible that the gripper arms 9 of the first gripper device 5 pick up an open bag from the bag supply 2 or the bag production and attach this to the filling nozzle 101. For this purpose, the first gripper device 5 or for this purpose, the gripper arms 9 in the exemplary embodiment shown here can also be displaced forwards and pulled back again, which is shown purely schematically in FIGS. 7 and 8.

Figure 9:
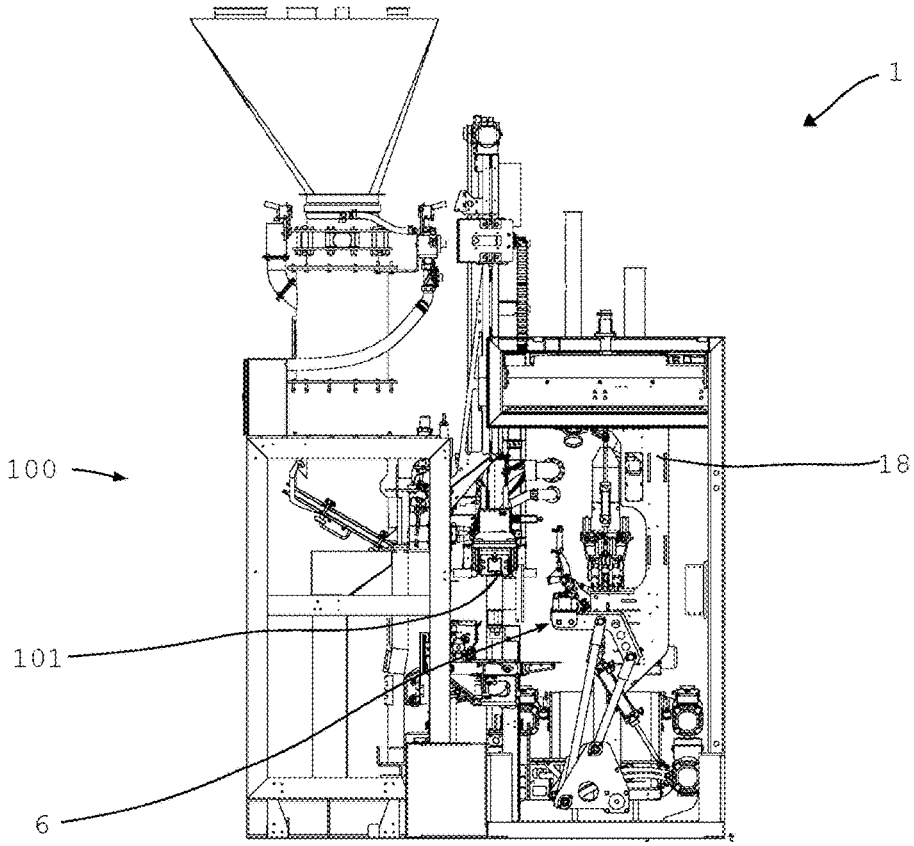
FIG. 9 shows a purely schematic diagram of an exemplary embodiment of a packing machine according to the invention in a view from the side of the bag supply.

FIG. 9 shows purely schematically the view of the transfer device 4 and the filling module 100 from the direction of the bag supply 2. In this case, the base body 18 of the transfer device 4 is rotated in such a manner that the second gripper device 6 is aligned in the direction of the filling nozzle 101 of the filling module 100. In this position, the first gripper device 5 is aligned in such a manner that it can receive an empty bag from the bag supply 2.

Figure 10:
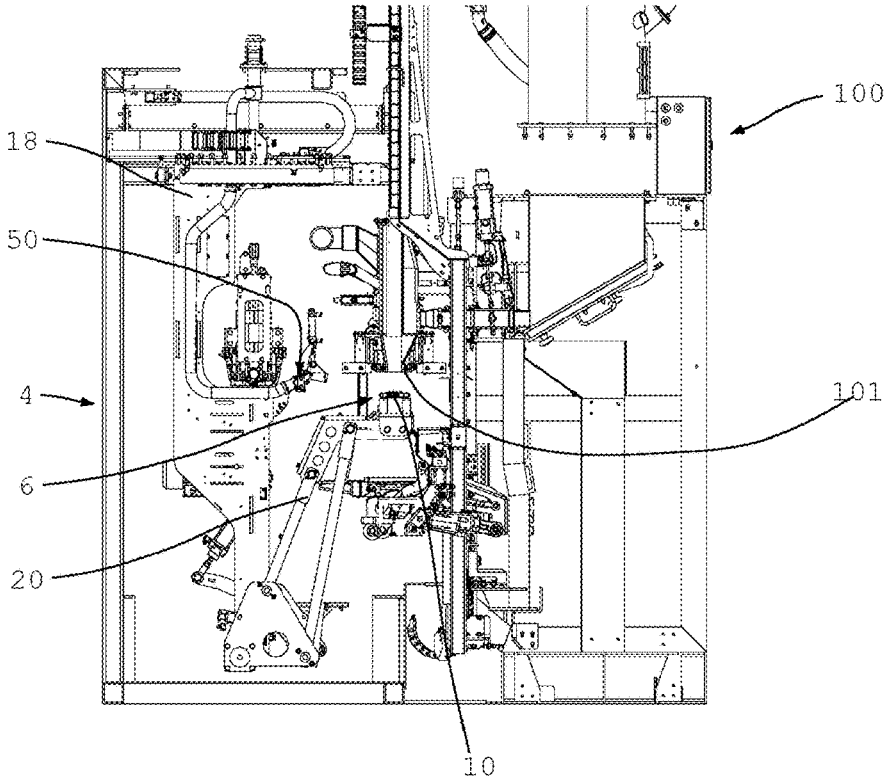
FIG. 10 shows a purely schematic diagram of an exemplary embodiment of a packing machine according to the invention in a view from the side of the bag removal.

FIG. 10 shows a purely schematic view of the transfer device 4 and the filling module 100 from the side of the bag removal 3.

Here it can be seen that the second gripper device 6 is provided to be displaceable so that the second gripper device 6 in the exemplary embodiment shown can be pivoted or displaced forwards via a parallelogram-like structure 20 in the direction of the filling nozzle 101. Thus, the clamping devices 10 of the second gripper device 6 can compress the still open bag walls of the filled bag and then displace the bag back in the direction of the base body 18.

Subsequently, the base body 18 can be rotated clockwise by 90° here so that the full bag can be displaced back into the line 12 and then fed to the bag removal. At the same time, during the removal of the full bag by the second gripper device 6, a new empty bag can be picked up by the first gripper device 5. When turning the full bag forwards into the line 12, a new empty bag is then simultaneously moved out of line 12 and fed to the filling nozzle 101.

In FIG. 10 it can also be seen that a cleaning device according to the invention 50 is provided above the second gripper device 6, which is explained in detail in the subsequent figures.

Figure 11:
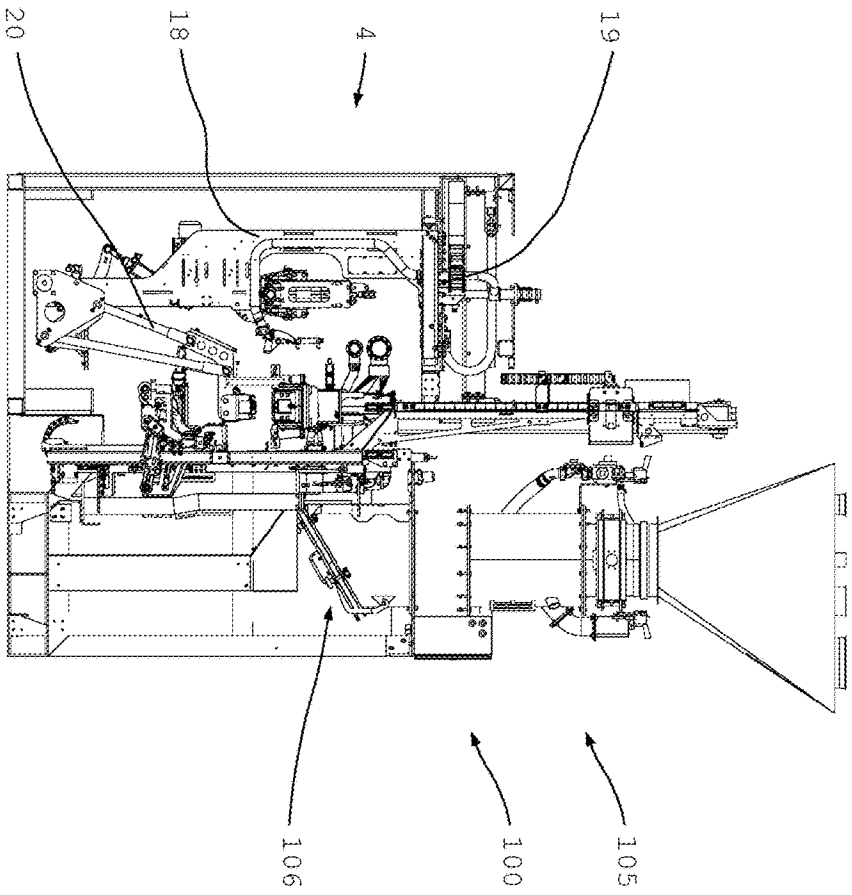
FIG. 11 shows a further purely schematic diagram of an exemplary embodiment of a packing machine according to the invention in a view from the side of the bag removal.
Figure 12:
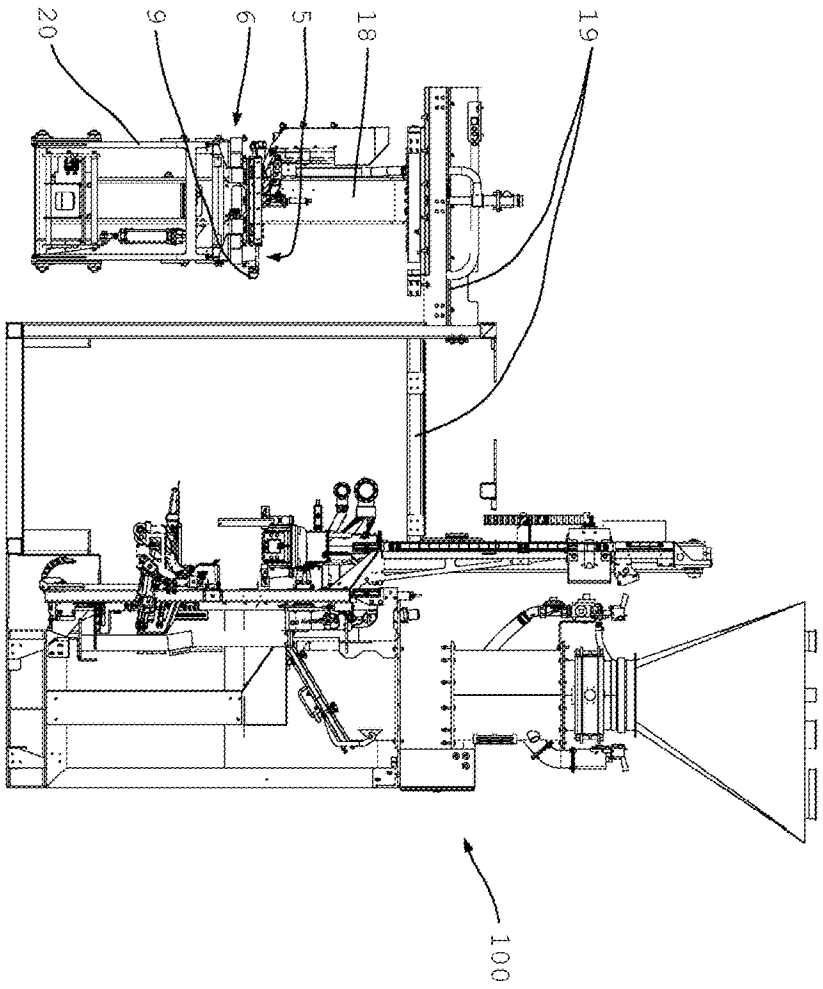
FIG. 12 shows the view according to FIG. 11 with pulled-out transfer device.

FIGS. 11 and 12 show purely schematically once again a side view of the packing machine 1 or of the transfer device 4 and the filling module 100 from the direction of the bag removal 3. When this view is compared, it can be seen that the transfer device 4 or the base body 18 together with the gripper devices 5, 6 fastened thereon is configured to be movable or extendable.

For this purpose, as already stated in the exemplary embodiment shown here, the base body 18 is suspended in an upper region and displaceable via a rail 19 or a rail system 19. Other technical components or components for displacing the base body 18 can be used analogously.

Since in the exemplary embodiment shown here, the transfer device 4 or the base body 18 of the transfer device 4 can be pulled out transversely to the line 12, for example, a sufficient space for maintenance staff is provided for maintenance of the packing machine 1.

Thus, in the extended state of the base body 18 in the exemplary embodiment shown here it is in particular possible to comfortably reach all the assemblies of the packing machine 1. In particular, the filling module 100 can be reached from the side of the filling nozzle 101. However, the bag supply 2, the bag removal and also the otherwise inaccessible side of the transfer device can be maintained and/or repaired.

Figure 13:
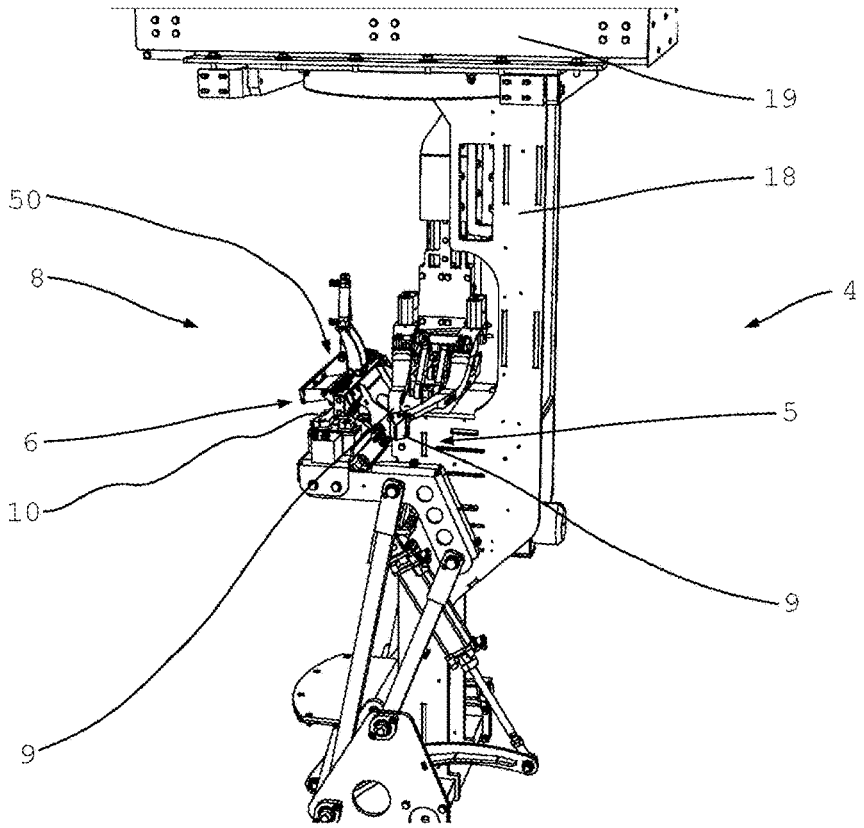
FIG. 13 shows a purely schematic diagram of an exemplary embodiment of a transfer device.
Figure 14:
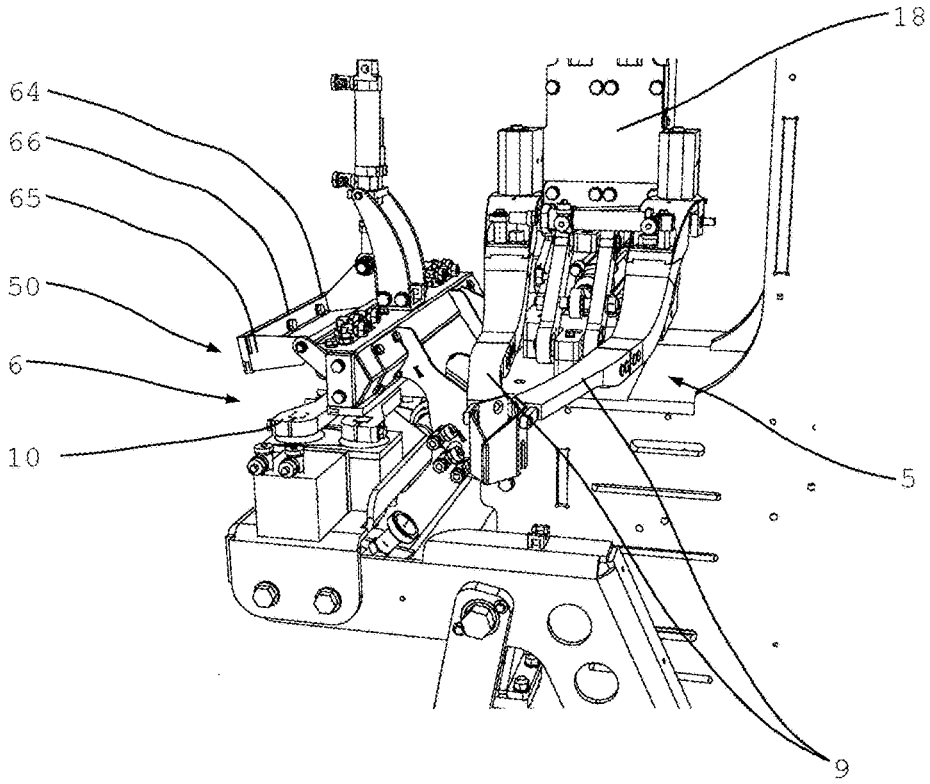
FIG. 14 shows an enlargement according to FIG. 13.

FIGS. 13 and 14 show the transfer device 4 or the base body 18 of the transfer device 4 of the packing machine 1 in an overview diagram and a detailed view.

The first gripper device 5 and the second gripper device 6 are arranged in this exemplary embodiment offset by 90° on the different sides 7, 8. As a result of this arrangement a superimposed operating mode of the empty bag and the full bag transfer or transport is ensured.

A cleaning device 50 is provided above the second gripper device 6, which comprises a housing device 64, wherein in the exemplary embodiment shown here a pivotable housing element 65 or a pivotable flap 66 is provided. The cleaning device 50 is explained in more detail in subsequent figures.

In addition, it can be seen that the first gripper device 5 is arranged on the side 7 of the base body 18, which, in the exemplary embodiment shown here, comprises two gripper arms 9, which can be moved here relative to each other or pivoted outwards or moved. Thus, the gripper arms act as spreaders and can pick up an empty bag from bag supply 2 or take it from this.

Furthermore, as can already be seen previously in the figures, the first gripper device 5 is provided to be pivotable so that this can be displaced forwards in the direction of the filling nozzle 101 and also in the direction of the bag supply 2. Depending on the configuration, for example, telescopic gripper arms 9 or other components of the first gripper device 5 can be provided.

Figure 15:
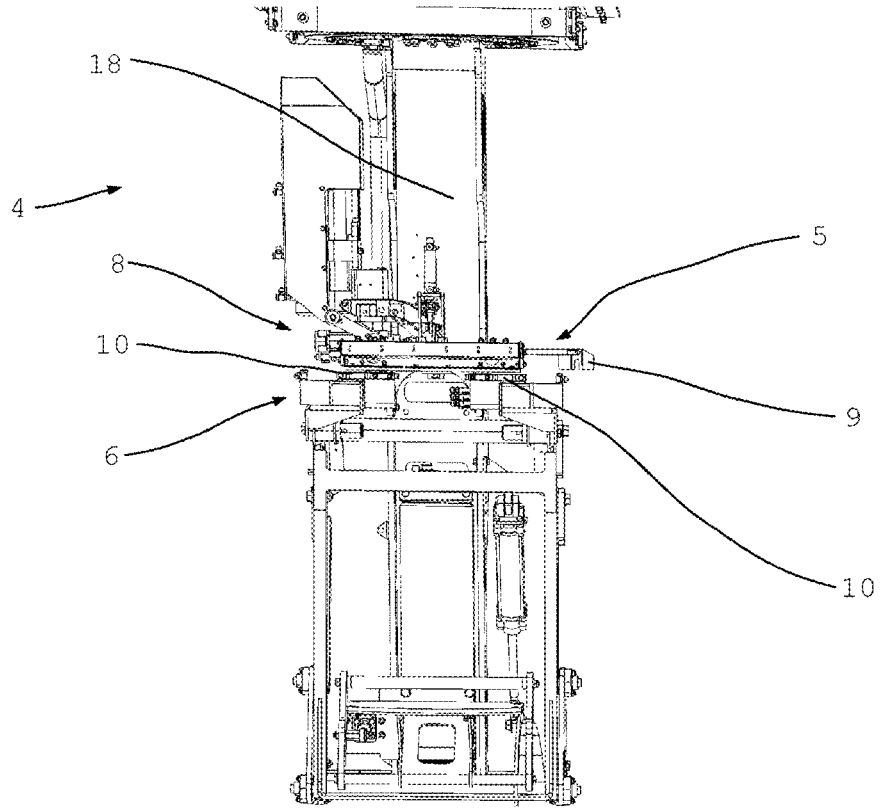
FIG. 15 shows a further purely schematic diagram of an exemplary embodiment of a transfer device.
Figure 16:
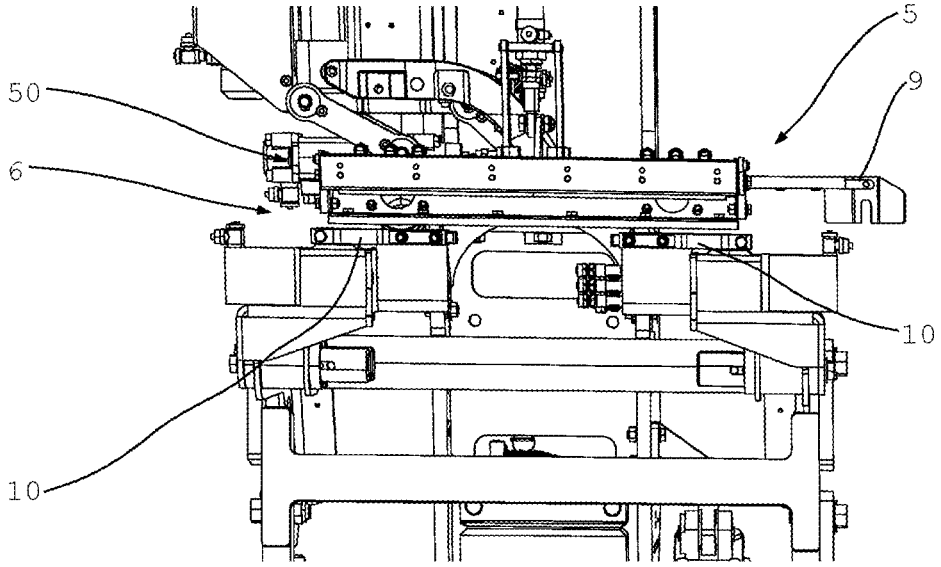
FIG. 16 shows an enlargement according to FIG. 15.

In FIGS. 15 and 16, the base body of the transfer device 4 is rotated in such a manner that the first gripper device 5 is aligned in the direction of the filling nozzle 101 of the filling module 100. In this position, an open bag not shown is held on the gripper arms 9 in the exemplary embodiment shown here by spreading the two gripper arms 9, wherein the gripper device 5 is displaced forwards to attach the bag which is held open to the filling nozzle 101. In addition, the second gripper device 6 with the clamping devices 10 can be identified.

Figure 17:
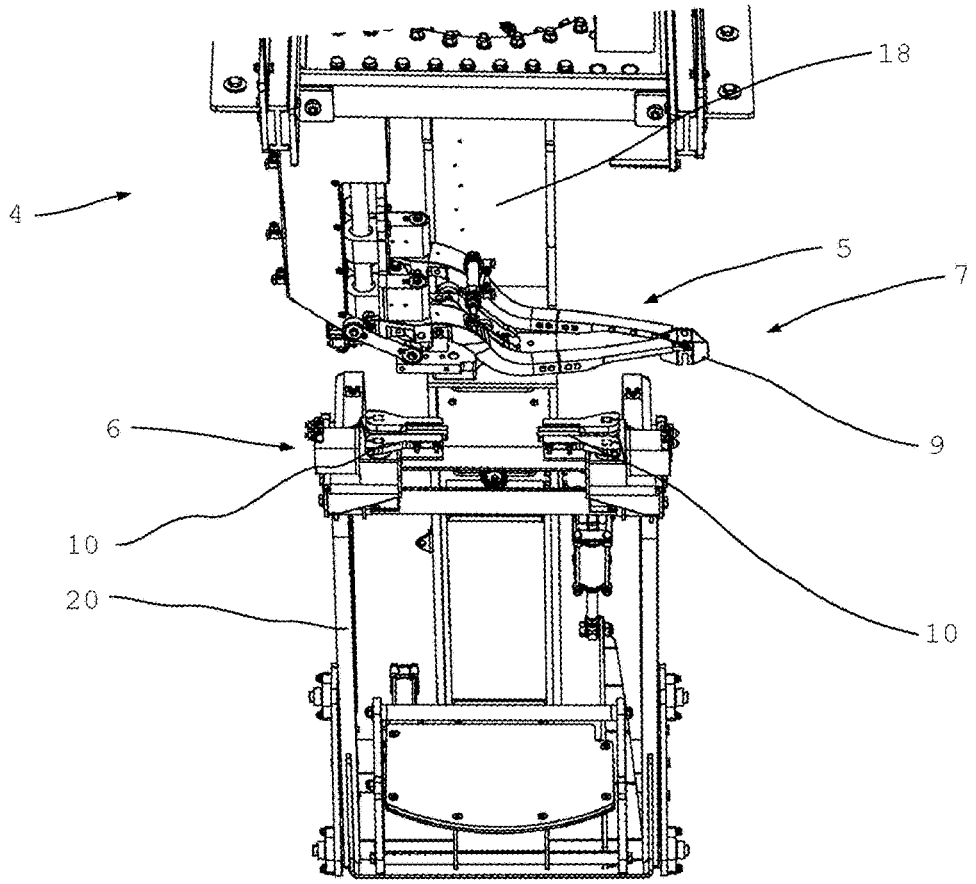
FIG. 17 shows a perspective view according to the view from FIG. 15.
Figure 18:
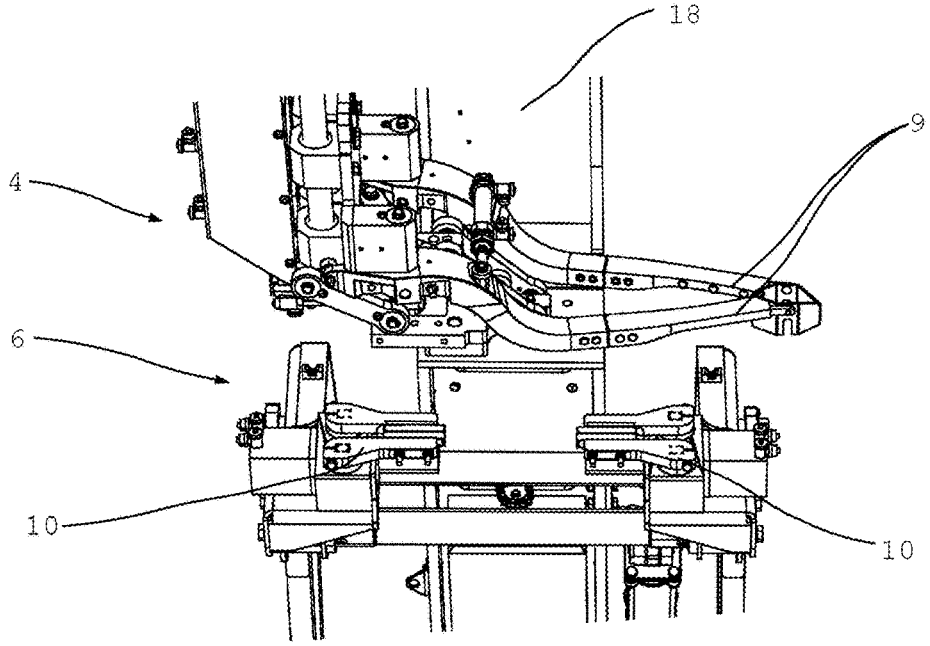
FIG. 18 shows an enlargement according to FIG. 17.

FIGS. 17 and 18 show the side view from FIGS. 15 and 16 again in a slightly perspective view from obliquely above, wherein in addition the cleaning device 50 above the second gripper device 6 is hidden in order to get a better impression of the clamping devices 10 of the second gripper device 6.

In FIGS. 19 to 24, the cleaning device 50 according to the invention provided above the second gripper device 6 in the exemplary embodiment shown here and its mode of operation is described in detail.

In this case, the cleaning device 50 according to the invention in the exemplary embodiment shown here is provided for cleaning the so-called head seam area of a bag to be closed by means of blown out air.

In addition to the application of the cleaning device 50 presented here, this can also clean any other work section, in particular in relation to the packing machine 1 described here.

Figure 19:
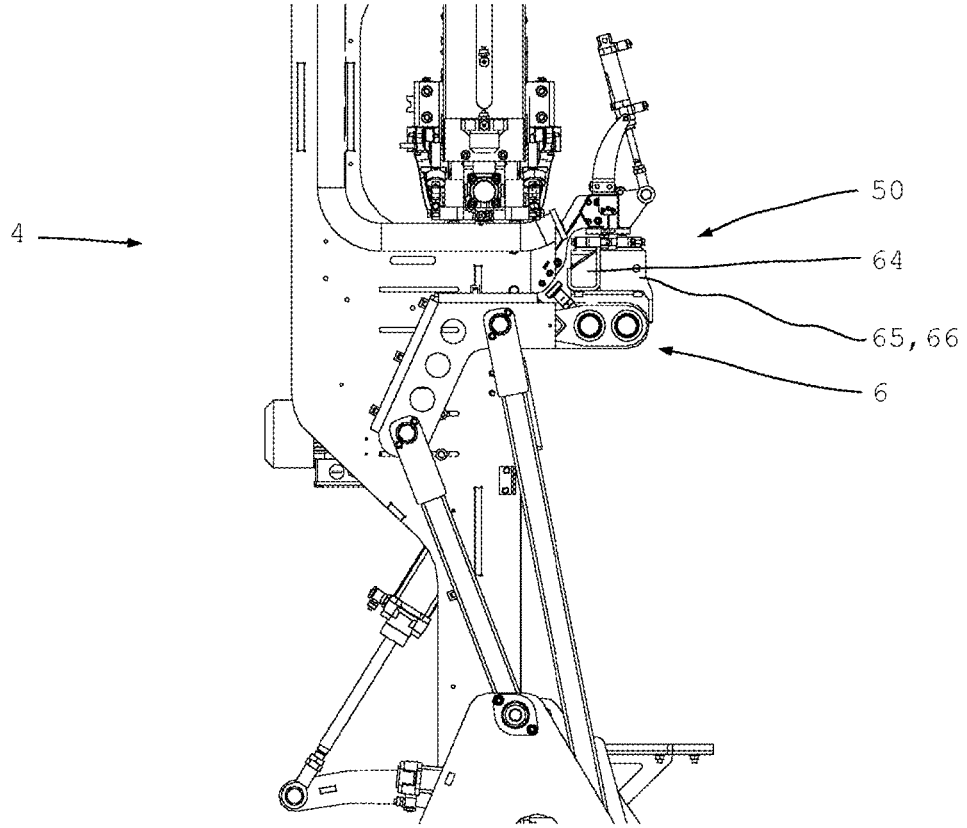
FIG. 19 shows a purely schematic view of an exemplary embodiment of a transfer device with a cleaning device according to the invention.

FIG. 19 shows an overview view of the transfer device 4 of the packing machine 1 according to the invention purely schematically, wherein in the exemplary embodiment shown here the cleaning device 50 according to the invention is arranged above the second gripper device 6.

In this exemplary embodiment, the cleaning device 50 comprises two blowing strips 51 which cannot be seen in FIG. 19. The cleaning device 50 is provided encapsulated in the exemplary embodiment shown here namely in a housing device 64. This makes it possible to achieve a hermetic sealing of the blowing strips 51 and the work section to be cleaned. In order to feed the work section to be cleaned or the bag to the cleaning device 50, the housing device 64 comprises a movable or, in this case, pivotable housing element 65 or a flap 66, which is shown in the closed state in the view shown.

Figure 20:
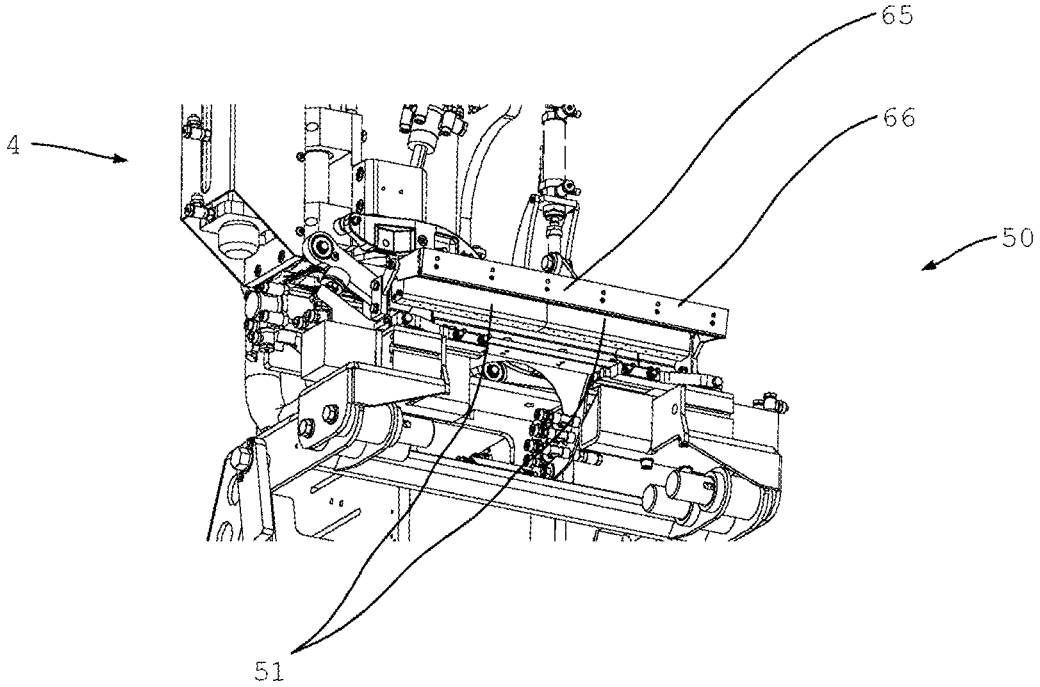
FIG. 20 shows a purely schematic diagram of a cleaning device according to the invention in a perspective view.

FIG. 20 shows in a perspective view a cleaning device according to the invention 50, wherein the movable housing element 65 or the flap 66 is shown in the open state. Thus, the view of the two blowing strips 51 located inside the housing device 64, shown here as an example, is free.

Figure 21:
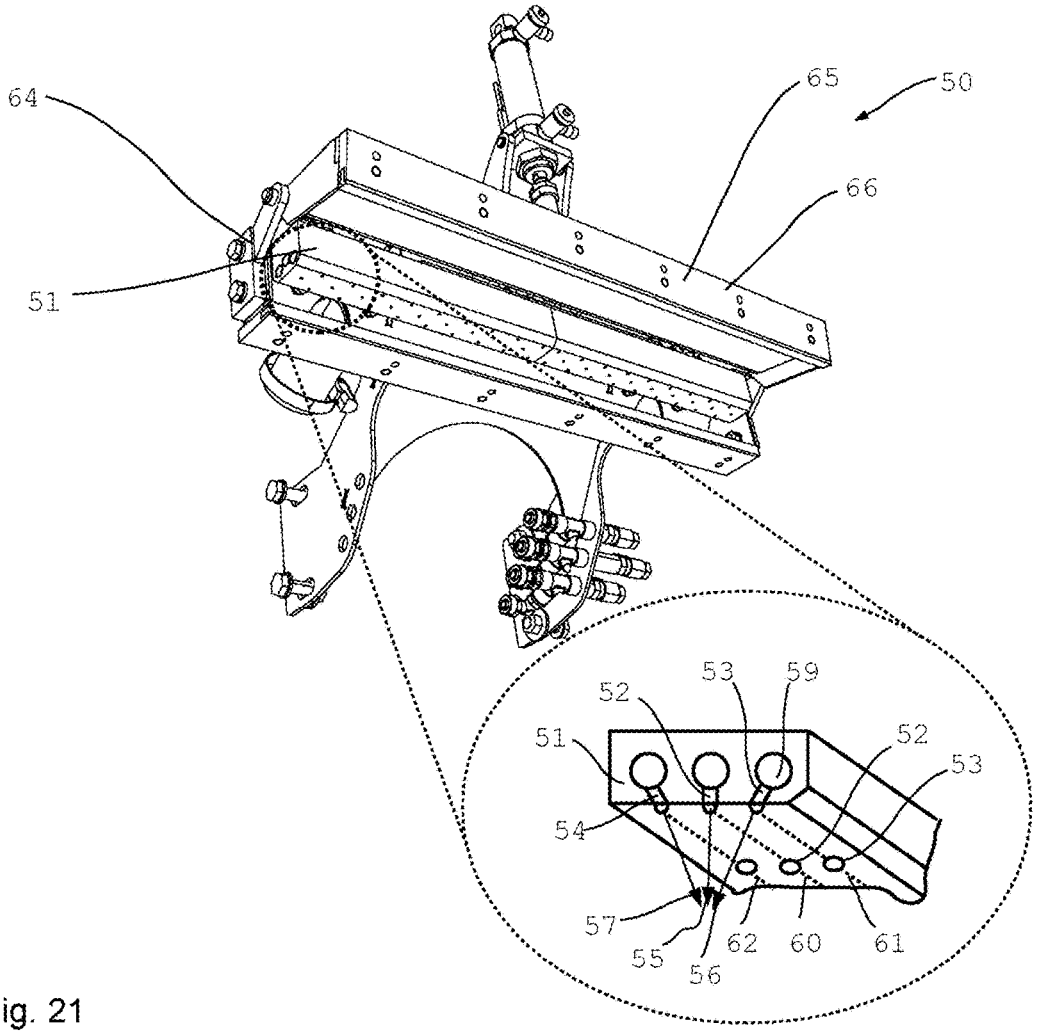
FIG. 21 shows a further purely schematic diagram of a cleaning device according to the invention in a perspective view.
Figure 22:
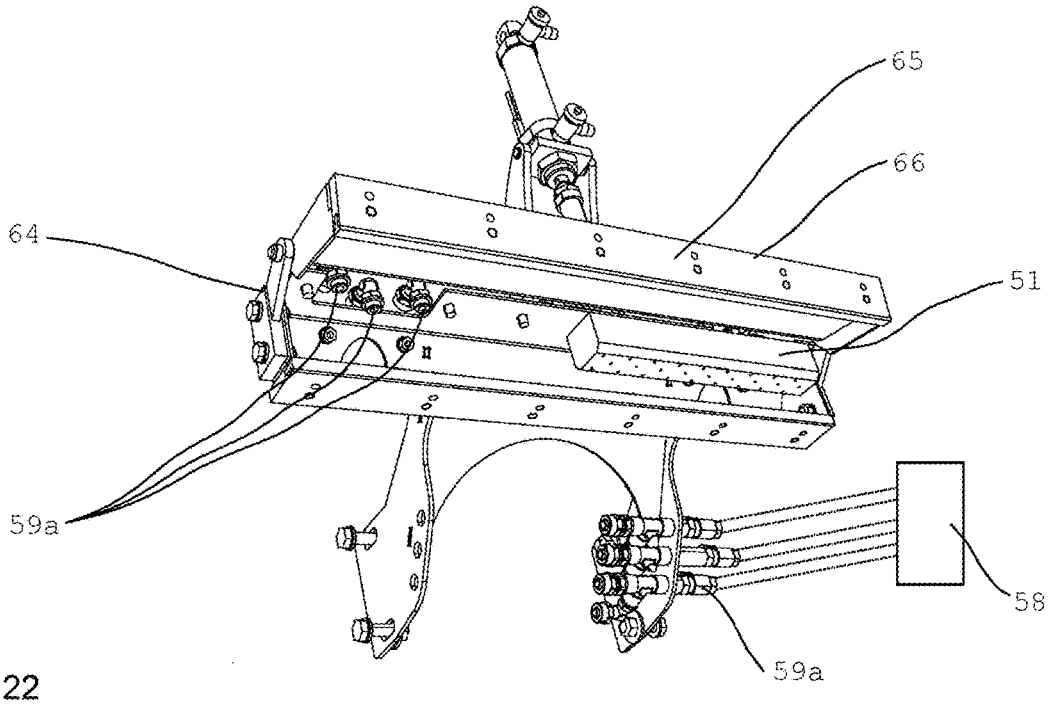
FIG. 22 shows a next purely schematic diagram of a cleaning device according to the invention in a perspective view.

In FIG. 21 in a perspective view, the assembly of the cleaning device 50 is shown separately in a perspective view. Here also, the flap 66 or the pivotable housing element 65 is shown in the open state, so that the two blowing strips 51 provided in the exemplary embodiment shown here can be seen.

In the exemplary embodiment shown here, the blowing strips 51 each comprise a plurality of first nozzle devices 52, second nozzle devices 53 and third nozzle devices 54, which are arranged here in rows 60, 61, 62.

In this case, the three rows 60, 61, 62 of the first nozzle devices 52, the second nozzle devices 53 and the third nozzle devices 54 can be supplied differently with air so that a moving air wave is blown out over the work section to be cleaned.

This is achieved whereby the first nozzle devices 52 or the first row 60 of first nozzle devices 52 each have a first blowing-out direction 55, which differs from the blowing-out directions 56, 57 of the other nozzle devices 53, 54 or rows 61, 62 of nozzle devices 53, 54. In particular, it is preferred and also provided in this exemplary embodiment that the first nozzle devices 52, the second nozzle devices 53 and the third nozzle devices 54 each have a blowing-out direction 50, 56, 57, which each differ from one another.

Furthermore, a control device 58 not shown in more detail in the figures is provided, which is suitable and configured to control the nozzle devices 52, 53, 54 at least at times in a temporally staggered manner For this purpose, it is provided in the exemplary embodiment shown that for the three rows 60, 61, 62 of nozzle devices 52, 53, 54 separate air supplies 59 are provided in each case within the blowing strips 51. This is provided here for both blowing strips 51 and can be identified in FIG. 22 purely schematically by hiding the left blowing strip 51. By hiding the one blowing strip 51 the separate air supplies 59*a* or the connections for the air supplies 59 of the blowing strip 51 located outside the blowing strip 51 can be seen.

Figure 23:
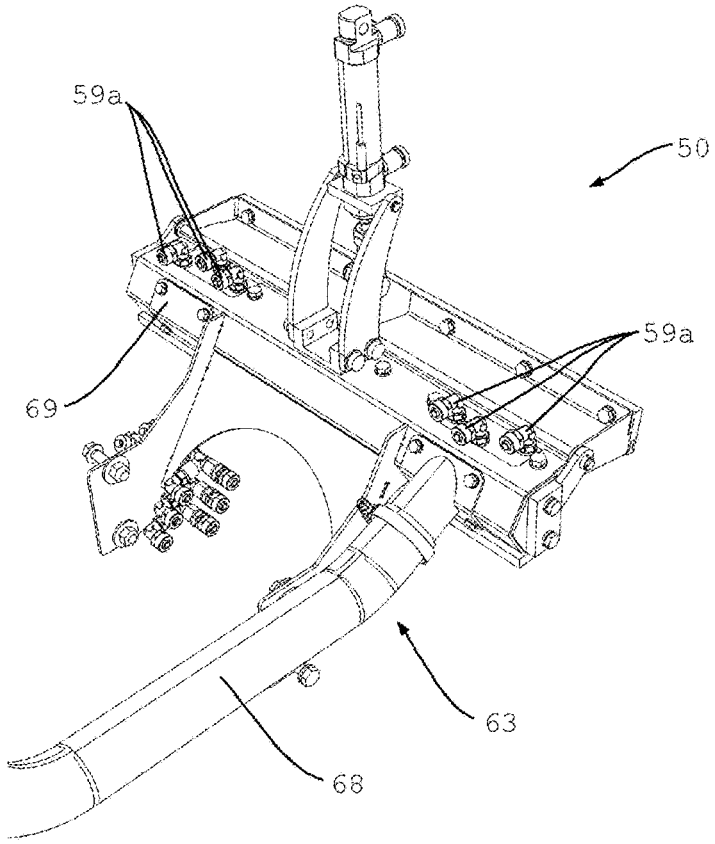
FIG. 23 shows another purely schematic diagram of a cleaning device according to the invention in a perspective view.
Figure 24:
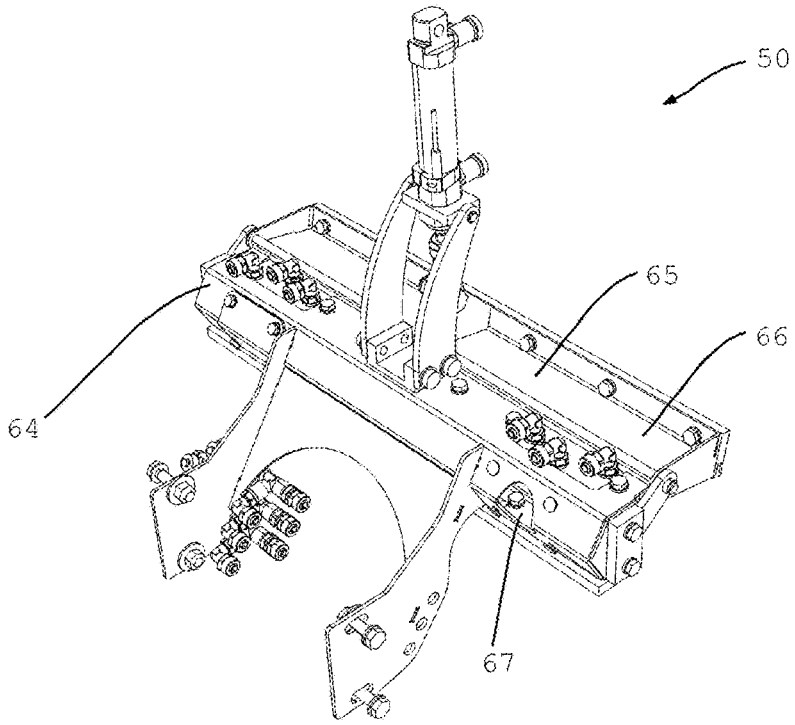
FIG. 24 shows a further purely schematic diagram of a cleaning device according to the invention in a perspective view.
Figure 25:
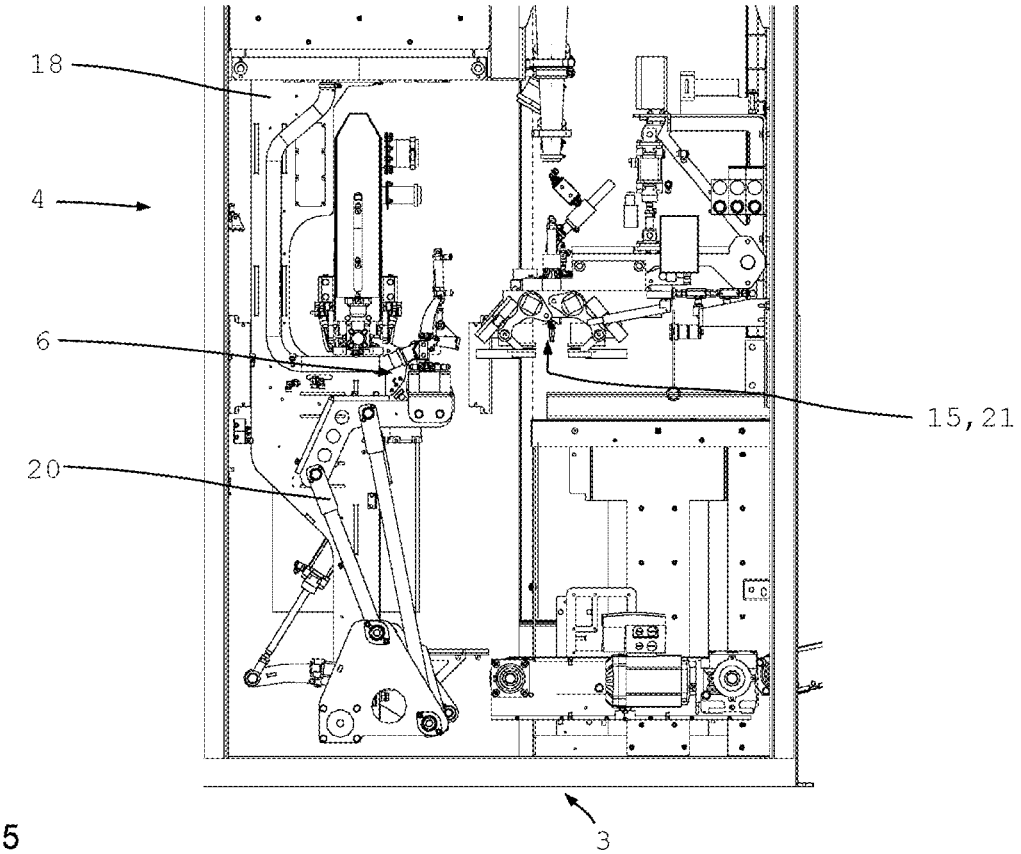
FIG. 25 shows a purely schematic diagram of an exemplary embodiment of a transfer device and a bag removal in a front view.
Figure 26:
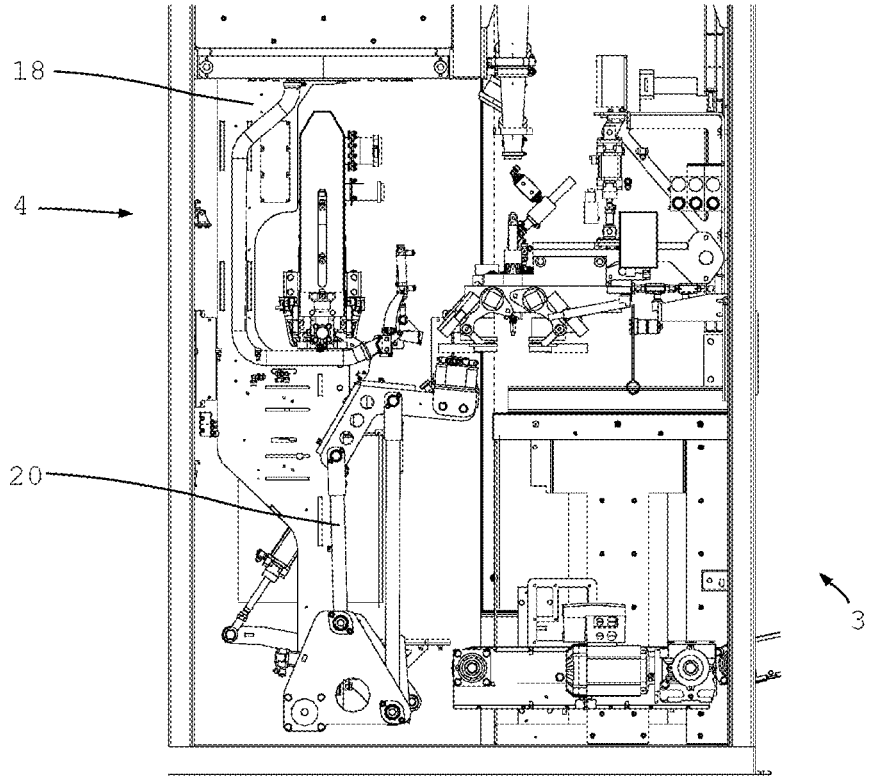
FIG. 26 shows a further purely schematic diagram of an exemplary embodiment of a transfer device and a bag removal in a front view.
Figure 27:
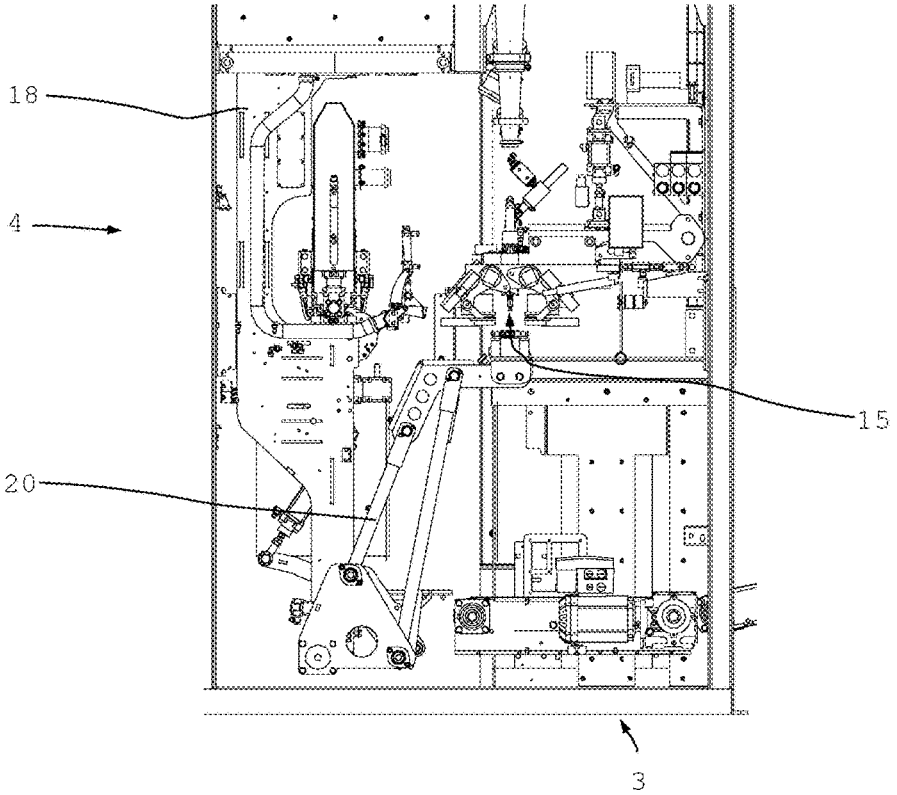
FIG. 27 shows a next purely schematic diagram of an exemplary embodiment of a transfer device and a bag removal in a front view.

FIGS. 23 and 24 show purely schematically that an extraction device 63 can also be provided to extract the air expelled by the blowing strips 51 or another fluid together with the swirled particles.

For this purpose, in the exemplary embodiment shown here the extraction device 63 is in operative connection with the interior of the housing device 64 via an opening 67 in the housing device 64.

In the exemplary embodiment shown, a suction pipe 68 is provided, which is connected to this opening 67. Depending on the configuration, for example, a further suction pipe 68 can be provided on the left side, wherein here the opening 67 is closed on the left side by a cover 69.

In the exemplary embodiment shown, as has already been described previously, it is provided that a hermetically substantially sealed cleaning space is created by closing the movable housing element 65 or the flap 66 of the housing device 64. Depending on the application, the extraction device is then set so that at least the air volume or generally the volume which is blown into the housing 64 through the blowing strips 51 is extracted. In particular, it is preferred that at least so much is extracted that at least a small vacuum is created inside the housing device 64. This is particularly important for systems that are used in dust explosion areas. In non-critical working environments or in general, a non-hermetically closing housing device 64 or even no housing device 64 can be provided.

In FIGS. 23 and 24 it can also be seen once again that the different rows 60, 61, 62 of the first, second and third nozzle devices 52, 53, 54 are connected via different air supply lines 59*a* per blowing strip 51.

Thus, the different control of the individual nozzle devices 52, 53, 54 or the individual rows 60, 61, 62 of these nozzle devices 52, 53, 54 is also possible differently per blowing strip 51. Thus, in the exemplary embodiment shown, an air wave or a moving air stream can be generated over the entire length and also over the width of the work section to be cleaned, whereby in particular the outlet pattern of a pendulum nozzle is modeled without using moving parts. In this case, in the blow-out pattern of a pendulum nozzle it is achieved that when cleaning the bag section for the subsequent head seam, the bag walls to be joined subsequently are blown apart so that product located between the bag walls is removed.

In particular, by means of an oscillating air jet it is achieved that when cleaning the bag mouth edge before closing or welding the filled bag by the moving air flow, the bag walls or film layers located on top of one another are opened by the acting air jet, so that the air jet impinges upon the inner surfaces, whereby the adhering dust or dirt particles are removed here. By changing the air jet, the layers of the side folds are also separated from each other with a corresponding design of the bag, so that this area is also cleaned. The individual film layers are as it were opened one after the other by the moving or oscillating air flow and cleaned by the air flow thus penetrating.

In FIGS. 25 to 28, the transfer of a filled bag by the transfer device 4 to the bag removal 3 is shown purely schematically.

In this case, a parallelogram-like structure 20 is provided, on which the second gripper device 6 with the clamping devices 10 is provided. This structure 20 is also used to remove the full bag from the filling nozzle 101 or to bring the second gripper device 6 into contact with the filled bag.

In the basic state, the second gripper device 6 abuts relatively closely against the base body 18 of the transfer device 4. In the following FIGS. 26 and 27 it can be seen how the second gripper device 6 moves forward in the direction of the bag removal 3 by displacing the parallelogram-like structure 20.

In this case, the closure device 15 can also be seen here, which is configured as a welding station 21 in the exemplary embodiment shown here.

Figure 28:
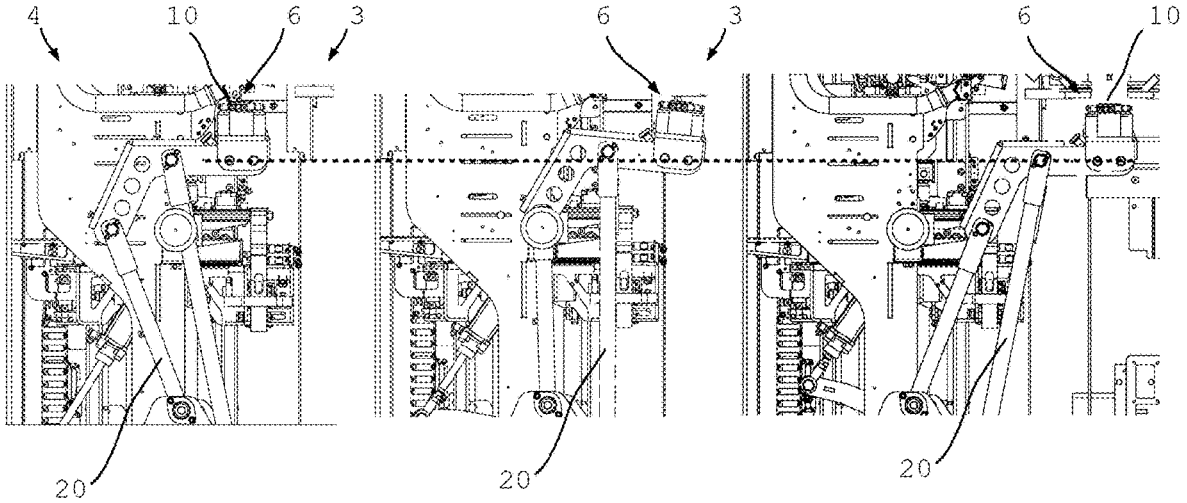
FIG. 28 shows sections from FIGS. 26, 27 and 28.
Figure 29:
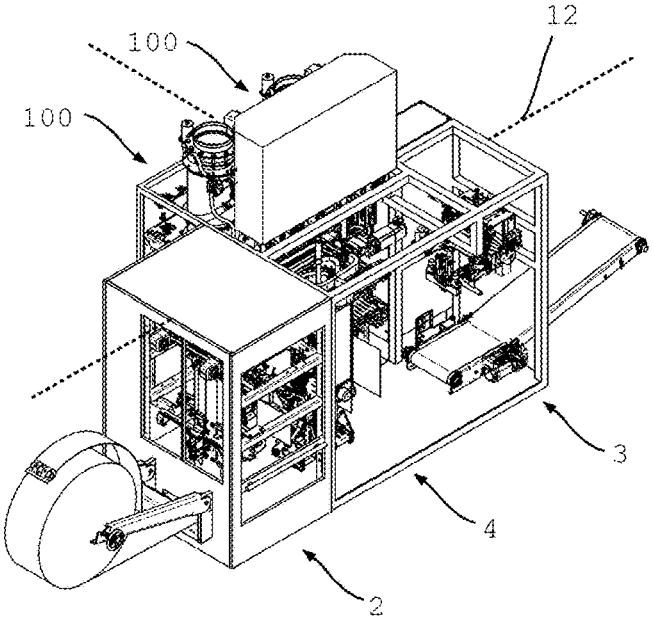
FIG. 29 shows a next exemplary embodiment of a packing machine according to the invention in a perspective view.
Figure 30:
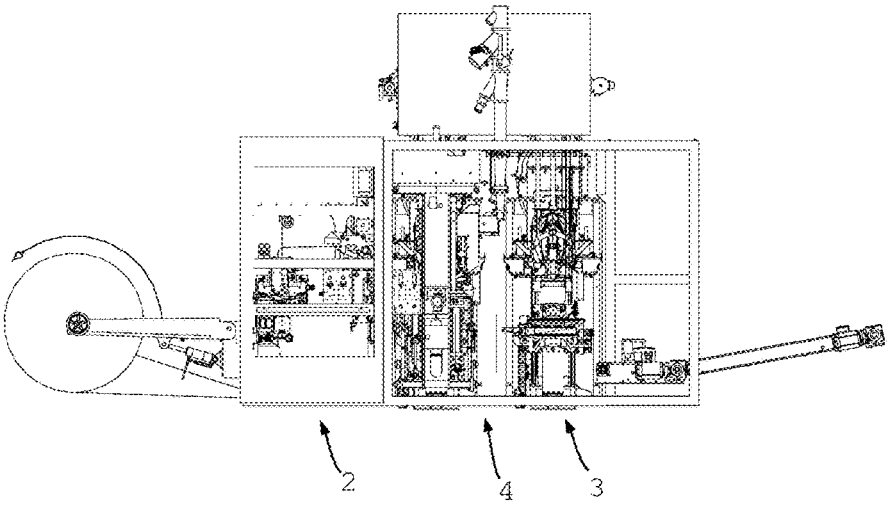
FIG. 30 shows the exemplary embodiment according to FIG. 29 in a front view.
Figure 31:
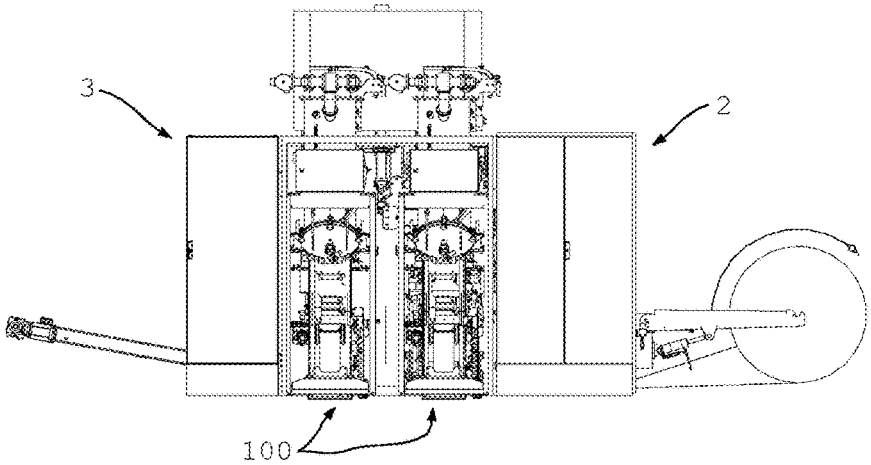
FIG. 31 shows the exemplary embodiment according to FIG. 29 in a rear view.
Figure 32:
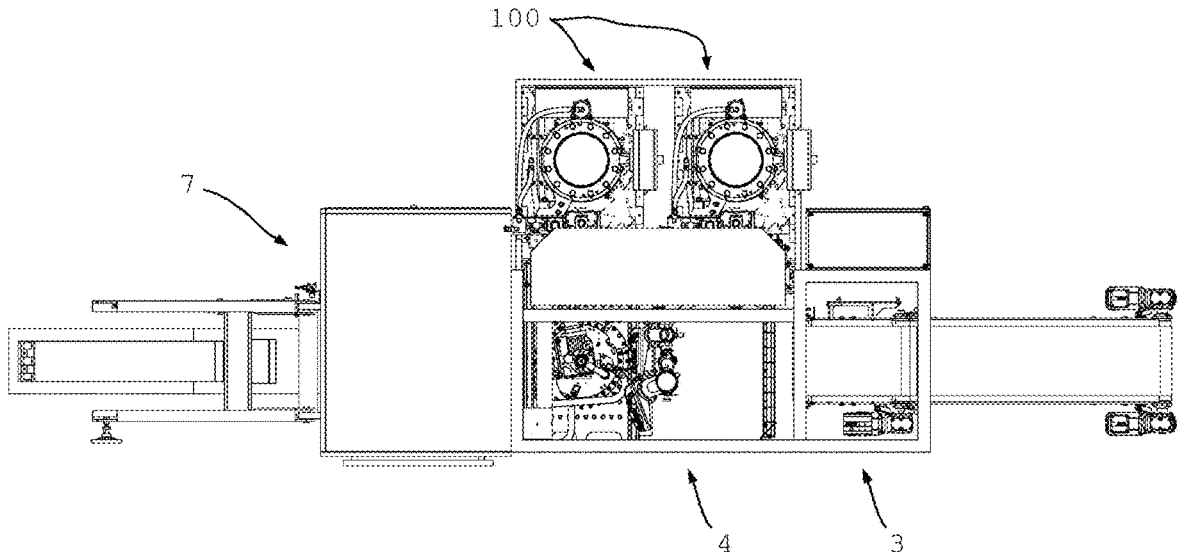
FIG. 32 shows the exemplary embodiment according to FIG. 29 in a plan view.
Figure 33:
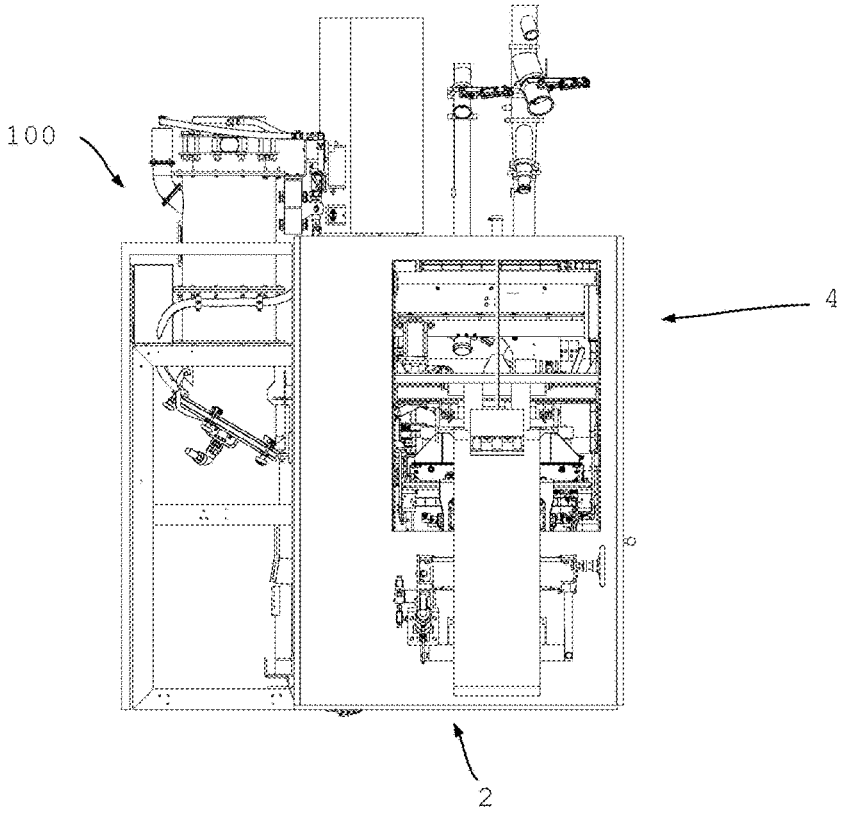
FIG. 33 shows the exemplary embodiment according to FIG. 29 in a side view.

FIG. 28 shows purely schematically by the side-by-side representation of the individual positions of the parallelogram-like structure 20 that due to the special configuration of this parallelogram-like structure 20, the filled bag is transferred by means of gripper device 6 of the transfer device 4 approximately on a line or approximately rectilinearly to the bag removal 3.

FIGS. 29 to 33 show a further exemplary embodiment of a packing machine 1 according to the invention. In this case, the configuration of this exemplary embodiment substantially corresponds to the exemplary embodiment already described.

In particular, the bag supply 2, the transfer device 4 and the bag removal 3 are arranged in a line 12. In contrast to the exemplary embodiment shown previously, not just one filling module 100 is pulled out of the line 12 and arranged next to the transfer device 4 but two filling modules 100 are arranged side by side outside the line 12.

In order to select which of the two filling modules 100 is used, in the exemplary embodiment shown here the transfer device 4 is provided to be movable so that this can be arranged either in front of one or the other filling module 100. For example, a quick product change or maintenance of a filling module 100 can be carried out, for which the transfer device 4 can be pushed or moved in front of the filling module 100 to be used or not to be maintained.

At the same time as the transfer device 4 can be displaced in the line 12, depending on the configuration, a movability or a displaceability of the transfer device 4 transverse to the line 12 can also be provided as in the exemplary embodiments shown previously.

In order to ensure a reliable picking up of bags from the bag supply 2 and a reliable delivery of the filled bags by the transfer device 4 to the bag removal 3, the individual components of the transfer device 4 can accordingly be provided to be displaceable.

Depending on the configuration, however, the bag supply 2 and/or the bag removal 3 can also be co-displaced so that there are always optimal distances between the individual assemblies.

While particular embodiments of the present packing machine and method for operation have been described herein, it will be appreciated by those skilled in the art that changes and modifications may be made thereto without departing from the invention in its broader aspects and as set forth in the following claims.

REFERENCE LIST

| | |
|---|---|
| 1 | Packing machine |
| 2 | Bag supply |
| 3 | Bag removal |
| 4 | Transfer device |
| 5 | First gripper device |
| 6 | Second gripper device |
| 7 | Side |

-continued

| | |
|---|---|
| 8 | Side |
| 9 | Gripper arm |
| 10 | Clamping device |
| 11 | Housing device |
| 12 | Line |
| 13 | Bag production |
| 14 | Film supply |
| 15 | Closure device |
| 16 | Conveyor belt |
| 17 | Housing cover |
| 18 | Base body |
| 19 | Rail |
| 20 | Parallelogram-like structure |
| 21 | Welding station |
| 50 | Cleaning apparatus |
| 51 | Blowing strip |
| 52 | First nozzle device |
| 53 | Second nozzle device |
| 54 | Third nozzle device |
| 55 | Blowing-out direction |
| 56 | Blowing-out direction |
| 57 | Blowing-out direction |
| 58 | Control device |
| 59 | Air supply |
| 59a | Air supply |
| 60 | Row |
| 61 | Row |
| 62 | Row |
| 63 | Suction device |
| 64 | Housing device |
| 65 | Housing element |
| 66 | Flap |
| 67 | Opening |
| 68 | Suction pipe |
| 69 | Cover |
| 100 | Filling module |
| 101 | Filling nozzle |
| 102 | Housing device |
| 103 | Housing cover |
| 104 | Inlet hopper |
| 105 | Air filling module |
| 106 | Pressure chamber |

The invention claimed is:

1. A packing machine for filling product into bags comprising:

at least one bag supply, at least one filling module with at least one filling nozzle and at least one bag removal; and between the bag supply and the bag removal at least one transfer device is provided, which is configured to feed an empty bag from the bag supply to the filling nozzle and to separately feed a filled bag from the filling nozzle to the bag removal, wherein the transfer device comprises a base body having at least a first gripper device to transfer empty bags from the bag supply to the filling nozzle and wherein the transfer device base body further comprises at least a second gripper device, separate on the transfer device from the first gripper device, to transfer filled bags from the filling nozzle to the bag removal; and, wherein the transfer device base body is rotatable for independently operationally engaging the first and second gripper devices relative to the bag supply, the filling nozzle and the bag removal so that the first gripper device attaches an empty bag to the filling nozzle for creating a filled bag, and, upon rotation of the base body, the second gripper device comes in contact with the filled bag on the filling nozzle and transfers the filled bag to the bag removal by rotation of the base body.

2. The packing machine according to claim 1, wherein the first gripper device for the transfer of the empty bags and the second gripper device for the transfer of the filled bags are arranged on different sides of the transfer device.

3. The packing machine according to claim 1, wherein the first gripper device for the transfer of the empty bags and the second gripper device for the transfer of the filled bags are arranged offset with respect to one another between 600 and 120° on the transfer device.

4. The packing machine according to claim 1, wherein the transfer device is rotatable between 60° and 120°.

5. The packing machine according to claim 1, wherein the transfer device is configured to be movable at least in sections.

6. The packing machine according to claim 1, wherein the first gripper device for the transfer of the empty bags is configured to be displaceable.

7. The packing machine according to claim 1, wherein the first gripper device comprises at least two gripper arms, which can be displaced relative to one another.

8. The packing machine according to claim 1, wherein the second gripper device for the transfer of the filled bags is configured to be displaceable.

9. The packing machine according to claim 1, wherein the second gripper device comprises at least one clamping device.

10. The packing machine according to claim 1, wherein the second gripper device is assigned at least one cleaning device.

11. The packing machine according to claim 1, wherein the bag supply, the filling module, the bag removal and/or the transfer device are arranged at least in sections in at least one housing device.

12. The packing machine according to claim 1, wherein at least two filling modules are provided.

13. The packing machine according to claim 12, wherein the filling modules are arranged side by side.

14. A method for operating a packing machine according to claim 1, comprising the following steps:

a) picking up an empty bag by the first gripper device;

b) turning the transfer device until the first gripper device is in operative connection with the filling module;

c) transferring the empty bag to the filling nozzle;

d) rotating the base body of the transfer device until the first gripper device is in operative connection with the bag supply;

e) rotating back the base body of the transfer device until the second gripper device is in operative connection with the filling module for filling the empty bag to create a filled bag or with the filled bag;

f) picking up the filled bag by the second gripper device;

g) rotating the base body of the transfer device until the second gripper device with the filled bag is in operative connection with the bag removal; and h) handing over the filled bag to the bag removal.

15. The method according to claim 14, wherein steps a) and f), b) and g), c) and h) are carried out in parallel/simultaneously.

16. The method according to claim 15, wherein steps d) and e) are also carried out simultaneously.

17. The method according to claim 14, where two filling modules are provided and wherein the transfer device is moved in front of the filling module of said two filling modules which is to be used.

18. A method for maintaining a packing machine according to claim 1, characterized in that the transfer device is moved in order to release at least the filling module.

19. The method according to claim 18, wherein the transfer device is pulled out to release the filling module.

20. The method according to claim 18, wherein two filling modules are provided and wherein the transfer device is moved laterally in front of the filling module of said two filling modules which is not maintained.

* * * * *